US007552837B2

(12) United States Patent
Nanjo et al.

(10) Patent No.: US 7,552,837 B2
(45) **Date of Patent: *Jun. 30, 2009**

(54) LIQUID CONTAINER SEALING JACKET, AND METHOD FOR UNSEALING LIQUID CONTAINER FITTED WITH LIQUID CONTAINER JACKET

(75) Inventors: Tatsuo Nanjo, Kawasaki (JP); Masanori Takenouchi, Yokohama (JP); Hajime Yamamoto, Fuchu (JP); Eiichiro Shimizu, Hong Kong (HK)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/388,393

(22) Filed: Mar. 17, 2003

(65) Prior Publication Data

US 2004/0003577 A1 Jan. 8, 2004

(30) Foreign Application Priority Data

Mar. 18, 2002 (JP) ..... 2002-074227
Feb. 14, 2003 (JP) ..... 2003-036544

(51) Int. Cl.
*B65D 51/16* (2006.01)

(52) U.S. Cl. ..... 220/360; 53/381.1; 53/381.4; 220/916

(58) Field of Classification Search ..... 206/497, 206/427; 220/495.04, 916; 426/397, 403; 229/117.29, 120, 120.03, 121, 122, 122.1
See application file for complete search history.

(56) References Cited

U.S. PATENT DOCUMENTS 3,325,058 A * 6/1967 West, Jr. ..... 222/146.5
5,231,416 A 7/1993 Terasawa et al.
5,356,029 A * 10/1994 Hogan ..... 229/117.3
5,430,471 A * 7/1995 Nakajima et al. ..... 347/87
5,500,663 A * 3/1996 Ujita et al. ..... 347/86
5,583,549 A 12/1996 Ujita ..... 347/86
5,589,862 A 12/1996 Ujita ..... 347/87

(Continued)

FOREIGN PATENT DOCUMENTS

EP 792749 9/1997

(Continued)

OTHER PUBLICATIONS

European Search Report, dated Sep. 3, 2007 in counterpart Application No. 05017034.9.

*Primary Examiner*—Christopher Harmon
(74) *Attorney, Agent, or Firm*—Fitzpatrick, Cella, Harper & Scinto

(57) ABSTRACT

A packaging structure for a liquid container including a liquid containing portion accommodating liquid, a liquid supply portion for supplying the liquid to an outside and an air vent for fluid communication with an ambience, the packing structure includes a covering member for covering and sealing the liquid supply portion and the air vent; the covering member including; an air vent sealing portion for sealing the air vent and a liquid supply portion sealing portion for sealing the liquid supply portion, and a connecting region for covering a connecting side of the liquid container which connects the air vent sealing portion and the liquid supply portion sealing portion, wherein the liquid supply portion sealing portion effects non-adhering sealing for the liquid supply portion, and the connecting region provides a resistance against unsealing of the liquid supply portion.

7 Claims, 12 Drawing Sheets

U.S. PATENT DOCUMENTS

| | | | | |
|---|---|---|---|---|
| 5,608,437 | A | 3/1997 | Iwata et al. | 347/86 |
| D378,660 | S * | 4/1997 | Ota et al. | D9/417 |
| 5,701,995 | A | 12/1997 | Higuma et al. | |
| 5,784,088 | A | 7/1998 | Ujita et al. | 347/86 |
| 6,164,769 | A | 12/2000 | Inada et al. | |
| 6,170,939 | B1 | 1/2001 | Ujita | 347/86 |
| 6,270,206 | B1 | 8/2001 | Shimizu et al. | 347/86 |
| 6,276,786 | B1 * | 8/2001 | Eida et al. | 347/86 |
| 6,286,946 | B1 | 9/2001 | Umemura et al. | |
| 6,325,500 | B1 | 12/2001 | Kitabatake et al. | 347/86 |
| 6,332,675 | B1 | 12/2001 | Koitabashi et al. | 347/86 |
| 6,334,674 | B1 | 1/2002 | Ono et al. | 347/86 |
| 6,347,865 | B1 | 2/2002 | Matsumoto et al. | 347/86 |
| 6,382,783 | B1 | 5/2002 | Hayashi | 347/85 |
| 6,402,298 | B1 | 6/2002 | Nanjo | 347/49 |
| 6,402,308 | B1 | 6/2002 | Hattori et al. | 347/86 |
| 6,422,674 | B1 | 7/2002 | Hinami et al. | 347/7 |
| 6,443,567 | B1 | 9/2002 | Hayashi | 347/85 |
| 6,450,631 | B1 | 9/2002 | Hayashi et al. | 347/86 |
| 6,454,399 | B2 | 9/2002 | Ujita et al. | 347/86 |
| 6,471,343 | B1 | 10/2002 | Shimizu et al. | 347/85 |
| 6,505,923 | B1 | 1/2003 | Yamamoto et al. | 347/85 |
| 6,511,167 | B1 | 1/2003 | Kitabatake | 347/86 |
| 6,530,654 | B2 | 3/2003 | Kitabatake | 347/86 |
| 6,543,886 | B1 | 4/2003 | Hattori | 347/85 |
| 6,598,963 | B1 | 7/2003 | Yamamoto | 347/85 |
| 6,709,092 | B2 | 3/2004 | Hayashi | 347/86 |
| 6,719,415 | B1 | 4/2004 | Hattori | 347/86 |
| 2001/0007463 | A1 | 7/2001 | Hayashi et al. | 347/86 |
| 2001/0017640 | A1 | 8/2001 | Inada et al. | |
| 2002/0051045 | A1 | 5/2002 | Koshikawa et al. | 347/86 |
| 2002/0084013 | A1 | 7/2002 | Sanada et al. | 156/62.2 |
| 2002/0109761 | A1 | 8/2002 | Shimizu et al. | 347/86 |
| 2002/0122103 | A1 | 9/2002 | Yamamoto et al. | 347/85 |
| 2002/0122104 | A1 | 9/2002 | Hatasa et al. | 347/86 |
| 2002/0167571 | A1 | 11/2002 | Hayashi et al. | 347/85 |
| 2002/0186284 | A1 | 12/2002 | Anma et al. | 347/85 |
| 2003/0085968 | A1 | 5/2003 | Shimizu et al. | 347/86 |
| 2003/0174192 | A1 | 9/2003 | Nanjo | 347/86 |
| 2003/0234844 | A1 | 12/2003 | Yamamoto et al. | 347/86 |

FOREIGN PATENT DOCUMENTS

| | | |
|---|---|---|
| JP | 6-328712 | 11/1994 |
| JP | 7-323565 | 12/1995 |

* cited by examiner (a)

(b)

(a)

(b)

LIQUID CONTAINER SEALING JACKET, AND METHOD FOR UNSEALING LIQUID CONTAINER FITTED WITH LIQUID CONTAINER JACKET

FIELD OF THE INVENTION AND RELATED ART

The present invention relates to an improved jacket for sealing a liquid container, which is for sealing a liquid container for storing recording liquid, for example, ink, supplied to the ink jet head of an ink jet recording apparatus, and which is removably connectable to the liquid supply path to the ink jet head. It also relates to a method for unsealing a liquid container fitted with such a liquid container sealing jacket. More specifically, it relates to a liquid container sealing jacket structured so that it is unlikely to allow such a problem as ink splash to occur, and a method for removing such a liquid container sealing jacket.

Conventionally, an ink jet recording head which ejects ink onto recording medium to form an image on the recording medium employs an ink container from which ink is supplied to the recording head through an ink supply tube or the like. There have been proposed various types of replaceable ink containers, which are independent from an ink jet recording head. Many of these replaceable ink containers comprise a shell, and a piece of ink absorbing member contained in the shell in order to retain ink. They are connected to the ink supply tube leading to an ink jet recording head. In order to facilitate the ink supply to the ink jet recording head, and also to prevent the ink leakage from the air vent of the ink container, through which the internal space of the ink container is connected to the ambient air, some of the containers have been known to be structured so that the ink content of the ink absorbing member is greater in the adjacencies of the ink outlet of the ink container than in the rest of the ink container, and smallest in the adjacencies of the air vent than in the rest of the ink container.

There is a possibility that ink will leak from an ink container of the above described replaceable type, through its ink outlet and/or air vent. Thus, it is a common practice to place a sealing jacket capable of sealing the ink outlet and air vent, around the ink container, in order to prevent the ink leakage. According to the prior art, a sealing jacket is placed around an ink container so that the ink outlet and air vent of the ink container are covered with the sealing jacket. Then, in order to keep the ink container hermetically sealed, the sealing jacket is glued, or thermally welded, to the ink container along the portions around the ink outlet and the portion around the air vent. A sealing jacket is inexpensive, and yet, is capable of reliably keeping an ink container hermetically sealed. Therefore, it is widely used to seal an ink container. All that is required of a user to unseal an ink container fitted with a sealing jacket, more specifically, to unseal the ink outlet and air vent sealed with the sealing jacket, is to peel the sealing jacket away from the adjacencies of the ink outlet and air vent, by directly pulling the sealing jacket.

There is a possibility that during the shipment of an ink container, a sealing jacket becomes partially undone due to the increase in the internal pressure of the ink container caused by the changes in the ambient factors. Thus, in order to prevent such an accident, a conventional sealing jacket has been very firmly glued, or thermally welded, to the ink container along the portions around the ink outlet and air vent; in other words, the adhesive strength between the sealing jacket and ink container is made substantial, around the ink outlet and air vent. Therefore, a user has to apply a substantial amount of muscular force, in order to remove the sealing jacket.

This creates the following problem. That is, in order to peel the sealing jacket from around the ink outlet and air vent, a user has to pull the sealing jacket with a-substantial amount of muscular force, as described above. However, the substantial resistance coming from the adhesive strength between the sealing jacket and ink container suddenly disappears the moment the sealing jacket becomes completely separated from the portions of the ink container around the ink outlet or air vent. As a result, the user's hand is suddenly let go in the direction in which it was pulling the sealing jacket, yanking the sealing jacket away from the ink container. Therefore, there is the possibility that the ink remaining sealed by the sealing jacket will be splashed, in particular, from the ink outlet, soiling the user's hand as well as the surroundings.

There are two bodies of ink which are splashed: the first body of ink which is thought to be between the ink absorbent member and sealing jacket, and the second body of ink adhering to the sealing jacket itself.

Referring to FIGS. 9(*a*), 9(*b*), and 9(*c*), the first body of ink is subjected to the pressure which acts in the direction in which the internal volume of the ink container 51 increases, that is, in the direction in which the ink within the ink container is drawn out. The first body of ink is also affected by the inertia generated by the movement of the sealing jacket 52 being abruptly peeled. As a result, the body of ink 54 between the ink absorbent member 53 and the sealing jacket 52 is abruptly stretched by the sealing jacket 52. As a result, the body of ink 54 will abruptly split. However, as it abruptly splits, specks of ink which fail to remain on either the ink absorbent member 53 or sealing jacket 52, splash.

Referring to FIGS. 10(*a*), 10(*b*), and 10(*c*), the moment the sealing jacket 52 becomes completely separated from the ink outlet 55, the sealing jacket 52 is briefly yanked by the above described sudden movement of the user's hand. As a result, the second body of ink 54*a*, or the body of ink adhering to the surface of the sealing jacket, is sometimes shot out by the impact from the sudden movement of the sealing jacket 52, being splashed.

In the case of some ink containers, the cap 62 is welded to the ink outlet 61 at the welding seam 64 in order to assure that the ink outlet 61 remains sealed, for the purpose of preventing these bodies of ink from being splashed. This type of ink container 63 is to be unsealed in the following manner. First, in order to break the welding seam 64 between the cap 62 and ink outlet 61, the cap 62 is to be rotated in the direction opposite to the direction in which the cap 62 is to be rotated in the final stage of its removal. Then, the cap 62 is to be removed. Therefore, the internal pressure of the ink container 63 is not released while the cap 62 becomes literally separated from the ink outlet. Further, the cap 62 is removed after the breaking of the welding seam 64, eliminating the problem that the cap 62 is abruptly moved away from the ink outlet. In other words, the type of ink splashing, which sometimes occurs to an ink container employing the sealing jacket shown in FIG. 10, does not occur to these types of ink container, since the cap 62 of this type of ink container is opened by rotating the cap 62.

In the case of the ink containers with a cap structured as described above, the cap must be "twisted" to open it. "Twisting" means "turning the wrist while holding the cap", which is an operation rather difficult for children, older people, or people having troubles with their hands or wrists, to perform. Moreover, the cap of this type of ink container is firmly welded to assure that the ink container remains sealed with the cap, adding to the level of the difficulty in the twisting the cap. Thus, a sealing jacket for an ink container, which is structured so that an ink container can be easily unsealed by anybody, has been desired.

SUMMARY OF THE INVENTION

The present invention is made in consideration of the above described problems, and its primary object is to provide a highly reliable sealing jacket for a liquid container, which is capable of preventing ink from splashing from the ink outlet of an ink container during the unsealing of the ink container, and yet can be easily removed by anybody, and also to provide a method for unsealing a liquid container fitted with such a sealing jacket.

According to an aspect of the present invention, there is provided a packaging structure for a liquid container including a liquid containing portion accommodating liquid, a liquid supply portion for supplying the liquid to an outside and an air vent for fluid communication with an ambience, comprising a covering member for covering and sealing said liquid supply portion and said air vent; said covering member including an air vent sealing portion for sealing said air vent and a liquid supply portion sealing portion for sealing said liquid supply portion, and a connecting region for covering a connecting side of said liquid container which connects said air vent sealing portion and said liquid supply portion sealing portion, wherein said liquid supply portion sealing portion effects non-adhering sealing for said liquid supply portion, and said connecting region provides a resistance against unsealing of said liquid supply portion.

According to another aspect of the present invention, there is provided an unsealing method for unsealing a packaging structure for a liquid container including a liquid containing portion accommodating liquid, a liquid supply portion for supplying the liquid to an outside and an air vent for fluid communication with an ambience, said packaging structure including a covering member for covering and sealing said liquid supply portion and said air vent; said covering member including; an air vent sealing portion for sealing said air vent and a liquid supply portion sealing portion for sealing said liquid supply portion, and a connecting region for covering a connecting side of said liquid container which connects said air vent sealing portion and said liquid supply portion sealing portion, wherein said liquid supply portion sealing portion effects non-adhering sealing for said liquid supply portion, and said connecting region provides a resistance against unsealing of said liquid supply portion, said method comprising a step of unsealing said air vent at said air vent sealing portion; a step of separating said first resistance generating portion from the side of said liquid container where said first resistance generating portion is provided; a step of unsealing said liquid supply portion at said liquid supply portion sealing portion where said liquid supply portion is sealed by the non-adhering sealing; and a step of separating said second resistance generating portion from the side of said liquid container where said second resistance generating portion is provided.

According to a further aspect of the present invention, there is provided a packaging structure for a liquid container having a liquid containing portion for containing liquid and a liquid supply opening for supplying the liquid, wherein said liquid supply opening is covered by a covering member, wherein said covering member has at least two independent adhered regions where said covering member is adhered to said liquid container at positions such that liquid supply opening is interposed between said two adhered regions.

According to a further aspect of the present invention, there is provided a packaging structure for a liquid container having a liquid containing portion for containing liquid and a liquid supply opening for supplying the liquid, wherein said liquid supply opening is covered by a covering member, wherein said covering member has independent adhered regions where said covering member is adhered to said liquid container and tearing means for tearing said covering member at respective positions such that liquid supply opening is interposed between said regions.

According to a further aspect of the present invention, there is provided a packaging structure for a liquid container including a liquid containing portion accommodating liquid, a liquid supply portion for supplying the liquid to an outside and an air vent for fluid communication with an ambience, the packing structure includes a covering member for covering and sealing the liquid supply portion and the air vent; the covering member including; an air vent sealing portion for sealing the air vent and a liquid supply portion sealing portion for sealing the liquid supply portion, and a connecting region for covering a connecting side of the liquid container which connects the air vent sealing portion and the liquid supply portion sealing portion, wherein the liquid supply portion sealing portion effects non-adhering sealing for the liquid supply portion, and the connecting region provides a resistance against unsealing of the liquid supply portion.

A liquid container fitted with the above described sealing jacket can be unsealed following the steps described next. First, a user is to peel the sealing jacket by grasping one end of the sealing jacket on the liquid container. The sealing jacket is adhered to the liquid container by its two adherent portions positioned one for one on both sides of the liquid outlet in terms of the direction in which the sealing jacket is to be removed. Thus, first, one (first) of the adherent portions of the sealing jacket is peeled. While this portion is peeled, the length of the first adherent portion, in terms of the direction in which it is peeled, makes it possible for a user to realize the amount of muscular force necessary to be exerted to peel the sealing jacket, preventing therefore the sealing jacket from being peeled too fast by the application of an excessive amount of force.

At the end of the peeling of the first adherent portion, the amount of the force necessary to peel the sealing jacket suddenly reduces to virtually zero. However, the user has not been applying an excessive amount of muscular force, as described above. Therefore, it does not occur that the user's hand grasping the sealing jacket jerkingly moves due to the sudden reduction in the resistance.

The portion of the sealing jacket corresponding to the liquid outlet of the liquid container is not adherent. Thus, at the end of the peeling of the first adherent portion, the liquid outlet becomes unsealed. As described above, during this process of peeling the first adherent portion, the sealing jacket is not abruptly peeled. Therefore, the liquid in, or adhering to, the liquid outlet is not splashed the moment the liquid outlet becomes unsealed. In addition, the sudden reduction, to virtually zero, of the resistance, against which the force necessary to peel the sealing jacket is being applied the user, gives the user the "sense of completion" that the liquid outlet has just been unsealed.

Moreover, this sealing jacket structured as described above can also prevent the liquid on the sealing jacket itself from splashing because, the second adherent portion of the sealing jacket functions as the stopper for preventing the rest of the sealing jacket from being abruptly peeled away in "one quick stroke".

Further, it is desired that this sealing jacket structured as described above has a sealing means positioned to hermetically seal the liquid storage portion as the sealing jacked is placed around an ink container, and also that in terms of the specific direction in which the sealing jacket is to be peeled, the first and second adherent portions of the sealing jacket are in front, and after, this sealing means, respectively.

Further, in the case of a liquid container having an air vent which connects the liquid storage portion to the ambient air, the air vent is desired to be in front of the sealing member, in terms of the specific direction in which the sealing jacket is to be peeled. With the provision of this structural arrangement, the air vent will open before the liquid outlet becomes unsealed during the peeling of the sealing jacket. Therefore, even if the internal pressure of the liquid container happen to have become higher, due to changes in the ambient temperature, than the ambient pressure, liquid can be prevented from being splashed from the liquid outlet the moment the liquid outlet becomes unsealed.

Further, the liquid container to be fitted with the sealing jacket structured as described above may be in the form of a rectangular parallelepiped. When giving the liquid container a rectangular parallelepiped shape, the shape is desired to be flat, and the liquid outlet is placed on the surface other than the largest surfaces. Such a liquid container is advantageous in terms of spatial efficiency, because when it is disposed in parallel by two or more, it occupies a smaller amount of space compared to a liquid container which is not in the above described form.

A liquid container shaped as described above is desired to be covered with the above described sealing jacket, at least across the surface having the ink outlet and the pair of surfaces contiguous to the surface having the ink outlet. Further, the first and second adherent portions of the sealing jacket for covering this liquid container correspond in position to the pair of liquid container surfaces contiguous to the surface with the liquid outlet, one for one.

Further, the sealing jacket is desired to be fitted around the ink container so that the second adherent portion of the sealing jacket, that is, the adherent portion positioned after the liquid outlet in terms of the specific direction in which the sealing jacket is to be peeled, covers the edge at which the liquid container surface with the liquid outlet intersects with the liquid container surface contiguous thereto. With the provision of this structural arrangement, it is possible to make the second adherent portion function as the above described stopper immediately after the unsealing of the ink outlet. Further, for the purpose of making the second adherent portion function as the stopper as soon as possible after the unsealing of the liquid outlet, the liquid outlet is desired to be disposed close to the liquid container surface corresponding in position to the second adherent portion of the sealing jacket.

Further, the liquid container is desired to have a sealing member for sealing the air vent connecting the internal space of the liquid container to the ambient air. This sealing member may be an integral part of the sealing jacket. When it is formed as an integral part of the sealing jacket, the sealing jacket is desired to be provided with a pair of perforations cut in parallel on the two sides of the sealing member, one for one, in terms of the direction in the sealing jacket is peeled.

As for the material for the sealing jacket, a sheet of film, preferably, a sheet of thermally shrinkable film, can used. The sealing jacket may be completely wrapped around a liquid container; it may be in the form of an endless belt. Further, it may be form of elastic material.

As for the means for attaching the sealing jacket to a liquid container, gluing or thermal welding may be employed.

As the above described sealing means, a cap may be employed. When a cap is used as the sealing means, the sealing portion of the cap is formed of elastic substance or elastomer.

The adherent portion of a sealing jacket, which is adhered to a liquid container, and the means for cutting the sealing jacket, may be independently disposed on the opposite sides with respect to the ink outlet. Such a design can also accomplish the above described objects of the present invention.

These and other objects, features, and advantages of the present invention will become more apparent upon consideration of the following description of the preferred embodiments of the present invention, taken in conjunction with the accompanying drawings.

BRIEF DESCRIPTION OF DRAWINGS

FIG. 1(*b*) corresponding to the ink container after the removal of the sealing jacket; FIG. 1(*c*) corresponding to the ink container immediately after the beginning of the peeling of the first adhesive portion shown in FIG. 1; and FIG. 1(*d*) corresponding to the ink container during the advanced stage of the peeling of the adherent portion of the sealing jacket.

DESCRIPTION OF THE PREFERRED EMBODIMENTS

Embodiment 1

Figure 1:
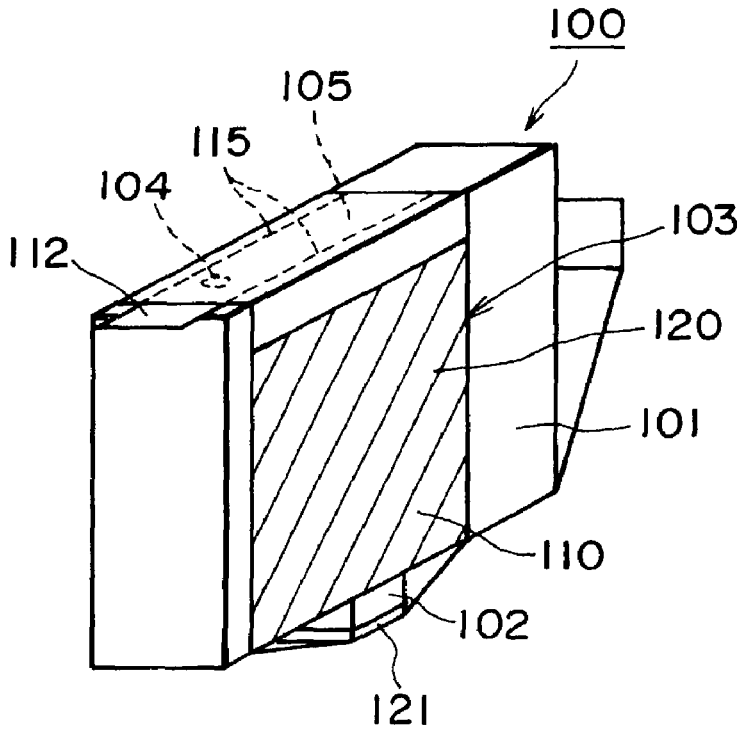
FIG. 1 is a drawing for describing the overall structure of the first embodiment of an ink container in accordance with the present invention, FIGS. 1(*a*) and 1(*b*) being a perspective and front plan views thereof, respectively.
Figure 1:
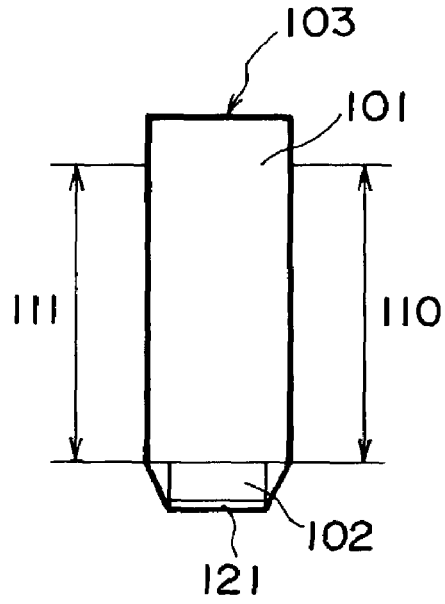

FIG. 1 is a drawing for describing the overall structure of the first embodiment of an ink container in accordance with the present invention, FIGS. 1(*a*) and 1(*b*) being perspective and front views the container, respectively.

The ink container 100 in FIG. 1 comprises: an ink container proper 101 for holding ink; an ink outlet 102 through which ink is supplied outward (for example, toward ink jet recording head); an air vent 104 through which air is introduced or expelled; a sealing member 105 for sealing the air vent 104; and a sealing jacket 103 for covering the entirety of the ink container proper 101 as well as the ink outlet 102. The sealing jacket 103 comprises a cap 121 for sealing the ink outlet 102; and a wrapping member 120 which wraps the ink container proper 101 as well as the cap 121. The sealing member 105 may be an integral part of the wrapping member 120. Further, the wrapping member 120 has first and second portions 110 and 111, respectively, coated with adhesive, which hereinafter will be referred to as first and second adherent portions (FIG. 1(*b*)).

Figure 11:
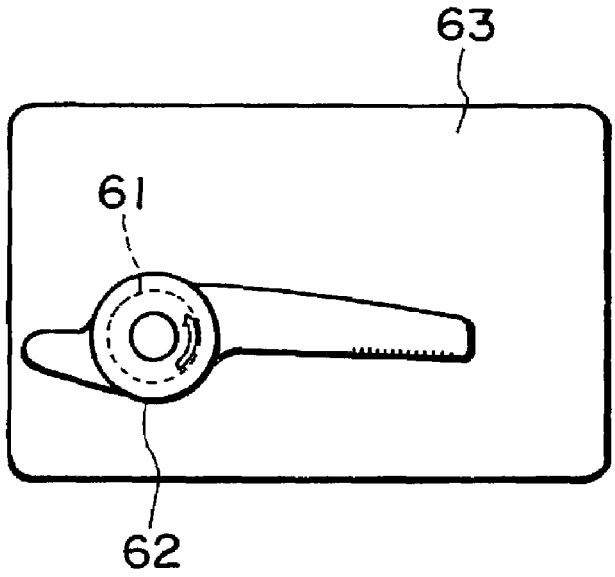
FIG. 11 is a plan view of the cap, and its adjacencies, of an example of an ink container in accordance with the prior art, for showing a structural arrangement in which the cap is utilized as the means for unsealing the ink container.
Figure 11:
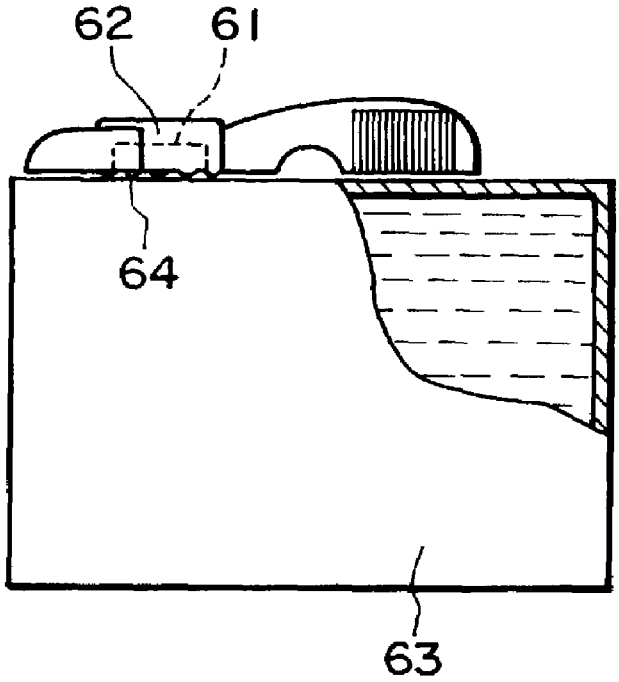

Incidentally, in FIG. 11, in order to show the structure of the ink container 100, the wrapping member 120 is pictured as a transparent member, and the adherent portions 110 and 111 are hatched.

Figure 2:
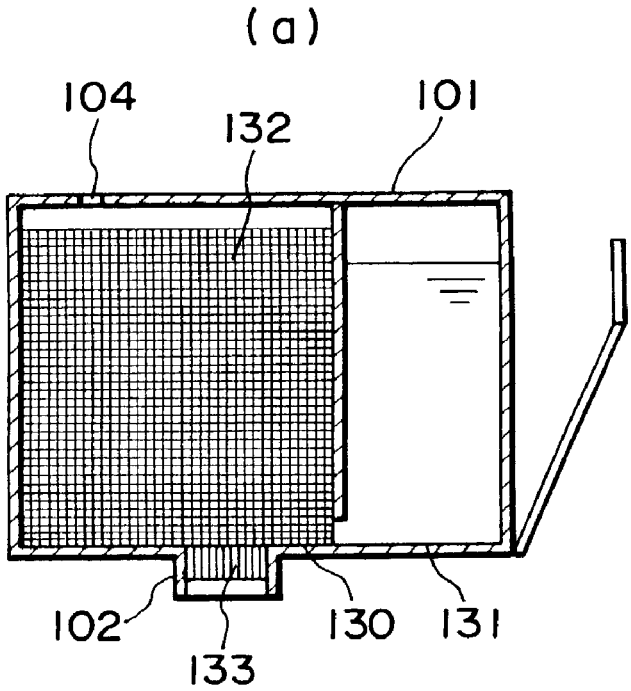
FIG. 2 is a sectional view of the ink container in FIG. 1, at a plane parallel to the largest wall of the ink container.
Figure 2:
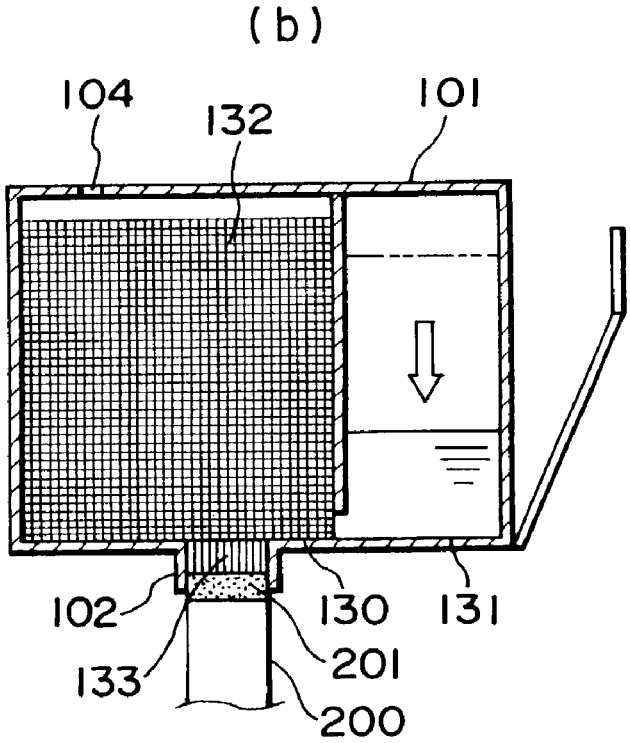

FIG. 2 is a sectional view of the ink container proper 101 at a plane parallel to the largest wall thereof. As is evident from this drawing, the ink container proper 101 is in the form of a parallelepiped, and is relatively flat. The internal space (liquid storage portion) comprises two chambers: a chamber 130 in which a negative pressure generating member is held, and ink storage chamber 131 located next to the negative pressure generating member holding chamber 130. The negative pressure generating member absorbs and retains ink by generating negative pressure, and the ink storage chamber 131 holds ink.

The partition wall partitioning the negative pressure generating member holding chamber 130 from the ink storage chamber 131 has a passage through which the two chambers are in connection with each other, and which is located at the edge of the negative pressure generating member holding chamber 130 next to the bottom wall of the ink container proper 101. The negative pressure generating member holding chamber 130 has the ink outlet 120 and air vent 104. The ink outlet 120 is attached to the bottom wall thereof. The air vent 104 is the passage between the internal space of the ink container proper 101 and the ambience, and is in the ceiling portion of the negative pressure generating member holding chamber 130. The ink outlet 102 is filled with a compressed member 133, as an ink drawing member, for efficiently drawing ink into the ink supply tube leading to the ink jet recording head.

Next, referring to FIG. 2(*b*), the ink delivery system of the ink container 100 will be described.

As the ink container 100 is mounted into an ink jet recording apparatus (unshown), the ink drawing tube 200 of the main assembly of the image forming apparatus enters the ink outlet 102, pressing on the compressed member 133. Some of the ink drawing tubes 200 have a filter 201, which is attached to the opening of the ink drawing tube 200 as shown in the drawing. Then, as the ink jet recording apparatus is operated, ink is ejected from the ink jet recording head (unshown), generating such force that suctions the ink from the ink container proper 101. As a result, the ink in the ink storage chamber 131 is drawn into the negative pressure generating member holding chamber 130, and then, is further drawn into the ink supply tube 200 through the negative pressure generating member 132, being thereby supplied to the ink jet recording head. Consequently, the internal pressure of the ink storage chamber 131 drops, creating pressure difference between the ink storage chamber 131 and negative pressure generating member holding chamber 130. This pressure difference temporarily increases as the ink is continuously supplied to the ink jet recording head due to its recording operation. However, since the negative pressure generating member holding chamber 130 has the air vent 104, through which the negative pressure generating member holding chamber 130 is open to the ambience, the ambient air enters the ink storage chamber 131 through the negative pressure generating member holding chamber 130, neutralizing the pressure difference between the ink storage chamber 131 and negative pressure generating member holding chamber 130. During the image forming operation, this creation and neutralizing of the pressure difference is repeated, making it possible for the ink to be smoothly supplied to the ink jet recording head.

Next, the sealing member 105 for sealing the air vent 104 will be described.

The air vent 104 is in the wall of the ink container proper 101, which opposes the wall of the ink container proper 101 having the ink outlet 102. It is open immediately adjacent to the negative pressure generating member 132. The sealing member 105 for sealing the air vent 104 is in the form of a piece of film, and is on the wall of the ink container proper 101, which has the air vent 104, being glued thereto in a manner to seal the air vent 104. The sealing member 105 should be off the ink container proper 101 when mounting the ink container 100 into the ink jet recording apparatus (unshown). Therefore, the sealing member 105 is attached to the ink container proper 101 using such an adhesive, or welding method, that allows it to be peeled away from the ink container proper 101 when necessary.

Figure 3:
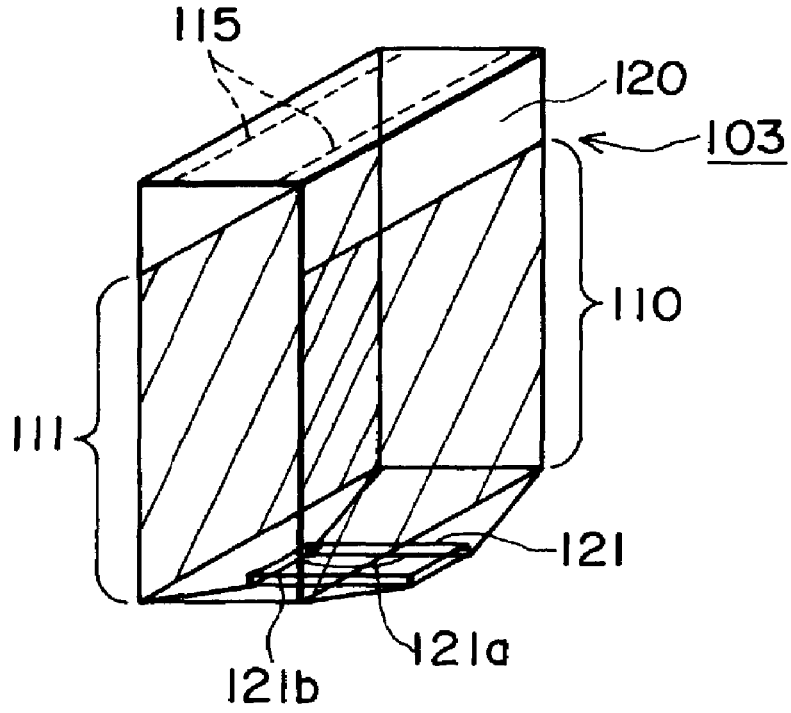
FIG. 3 is a perspective view of the sealing jacket for sealing the ink container in FIG. 1.

FIG. 3 is a perspective view of the sealing jacket 103 for sealing the ink container proper 101 as shown in FIG. 1. The hatched portions in the drawing represent the portions of the sealing jacket 103 by which the sealing jacket 103 is attached to the ink container proper 101. The sealing jacket 103 is in the form of an endless belt or band as shown in FIG. 3. As described before, the sealing jacket 103 comprises the cap 121 and wrapping belt portion 120. Referring to FIG. 1, the cap 121 is positioned so that it fits around the ink outlet 102 of the ink container proper 101 as the ink container proper 101 is wrapped with the sealing jacket 103. The material for the cap 121 is different from the material for the wrapping belt portion 120. The cap 121 is a member to be pressed on the ink outlet 102 to seal the ink container proper 101. Therefore, an easily pliable elastomer is desirable as the material for the cap 121.

Figure 4:
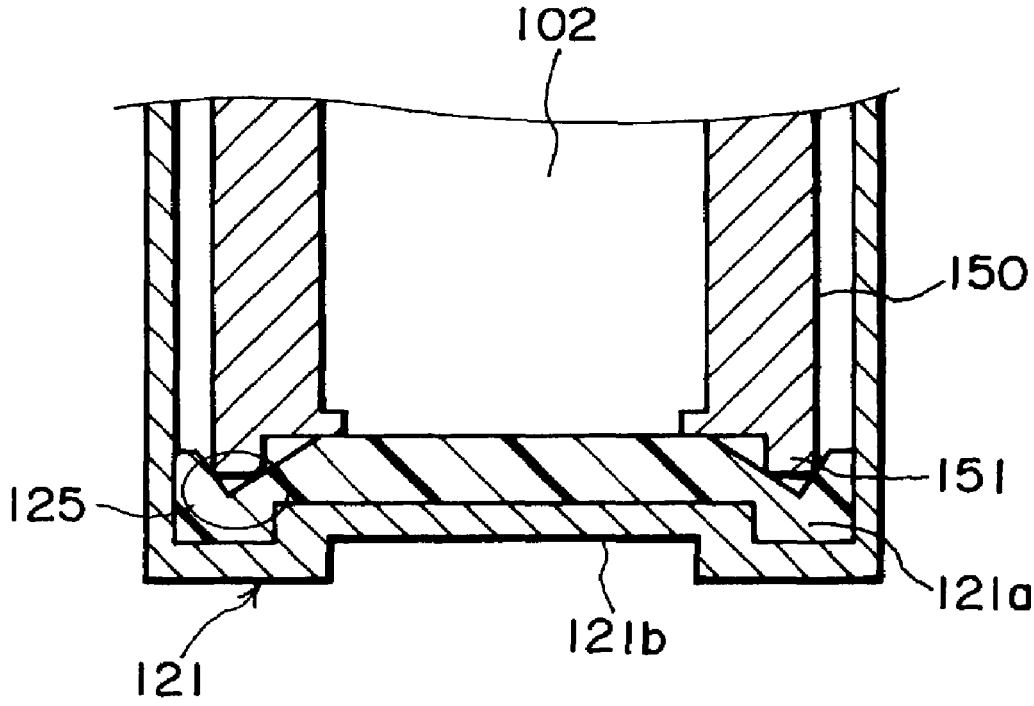
FIG. 4 is a sectional view of the ink outlet of the ink container, and the cap therefore, for showing the relationship between the ink outlet and the cap on the ink outlet.

The cap 121 of this embodiment is formed of two materials. That is, the portion of the cap 121 which is placed in contact with the ink outlet 102 to seal the ink container proper 101 is formed of elastomer, whereas the portion of the cap 121 surrounding the portion formed of elastomer is formed of polypropylene (FIG. 4).

Referring to FIG. 3, the cap 121 is fixed to the wrapping belt portion 120. As for the method to attach the cap 121 to the wrapping belt portion 120, the polypropylene portion of the cap 121 surrounding the elastomer portion of the cap 121 is glued, or welded, to the wrapping belt portion 120. Although the wrapping belt portion 120 and cap 121 of this embodiment are held together by welding, or with the use of adhesive, there is absolutely no problem even if a means other than welding or adhesive may be employed to hold the wrapping belt portion 120 and cap 121 together, as long as it assures that the cap 121 remains securely held by the wrapping belt portion 120.

Not only must the wrapping belt portion 120 be able to compactly wrap the entirety of the ink container proper 101 while being able to keep the cap 121 pressed against the ink outlet 102, as shown in FIG. 1, but also it must be able to keep the cap 121 against the ink outlet 102. In consideration of this fact, the material for the wrapping belt portion 120 is desired to be such film that can be thermally shrunk to conform to the external contour of the ink container proper 101. Obviously, the wrapping belt portion 120 may be a belt of film, one end of which can be welded to the other in a manner to form an endless belt after being wrapped around the ink container proper 101 so that the cap 121 is covered and retained by the wrapping belt portion 120.

Referring to FIGS. 1 and 3, the sealing member 105 is an integral part of the wrapping belt portion 120, which faces the wall of the ink container proper 101 having the air vent 104. The sealing member 105 is differentiated from the rest of the wrapping belt portion 120 by two straight lines of perforation 115 parallel to each other. With the provision of this structural arrangement, the wrapping belt portion 120 can be easily torn off by simply lifting the sealing member 105, exposing the air vent 104 as well as the ink outlet. In other words, the air vent 104 and ink outlet 102 can be exposed by a single action.

The wrapping belt portion 120 is fixed to the ink container proper 101 by the two adherent portions, that is, first and second adherent portions, of the wrapping belt portion 120 corresponding, one for one, to the two lateral surfaces of the ink container proper 101 which sandwich the surface of the ink container 101 having the ink outlet 102 (surfaces contiguous to the surface having ink outlet). Since these first and second adherent portions must be peelable from the ink container proper 101 when removing the wrapping belt portion 120, they are glued, or welded, to the ink container proper 101.

Next, the method for covering the ink container proper 101, inclusive of the ink outlet, with the sealing jacket 103 will be described.

The wrapping belt portion 120 of the sealing jacket 103 is in the form of a cylinder, which is greater in circumference than the portion of the ink container proper 101 to be wrapped by the wrapping belt portion 120. In order to the wrap the ink container proper 101 with the sealing jacket 103, the ink container proper 101 is placed inward of the wrapping belt portion 120. Then, the ink container proper 101 and sealing jacket 103 are positioned relative each other so that the cap 121 is placed in contact with the ink outlet 102. Then, the cap 121 is kept pressed on the ink outlet 102 with the use of a retaining jig (unshown), the structure of which is optional as long as it does not damage the elastomer portion 121*a* of the cap 121.

Next, the first and second adherent portions 110 and 111 coated with adhesive are pressed on the corresponding lateral surfaces of the ink container proper 101 to adhere thereto the first and second adherent portions 110 and 111. During this process, attention must be paid so that no air is left between the adherent portions 110 and 111 and corresponding surfaces of the ink container proper 101. Next, the wrapping belt portion 120 formed of shrinkable film, is thermally shrunk, while keeping the cap 121 pressed on the ink outlet 102 with the above described retaining jig, until the sealing jacket 103 conforms to the external contour of the ink container proper 101 tightly enough for the resultant tensile force of the sealing jacket 103 to keep the ink outlet sealed by the cap 121. Thereafter, the ink container proper 101 is released from the retaining jig, ending the process for covering the ink container proper 101 with the sealing jacket 103. FIG. 1 shows the ink container 100 after the completion of this process.

Next, referring to FIG. 4, the relationship between the ink outlet 102 and cap 121 after the thermal shrinking of the sealing jacket 103 will be described. FIG. 4 is a sectional view of the ink outlet 102, and the cap 121 on the ink outlet 102, for showing how the ink outlet 102 is kept sealed by the cap 121. In this drawing, the ink container proper 101 has a cylindrical portion 150, which projects from the edge of the ink outlet 102 in a manner to surround the ink outlet. The internal diameter of the cylindrical portion 150 is roughly the same as the diameter of the ink outlet 102. The end surface of the cylindrical portion 150 has a projection 151, and the elastomer portion 121*a* of the cap 121, with which the collar rib 150 makes contact, has a groove 125 with a V-shaped cross section (which hereinafter may simply be referred to as V-shaped groove), into which the projection 151 of the cylindrical portion 150 fits.

Referring to FIG. 4, as the projection 151 is pressed into the V-shaped groove 125, the projection enters the V-shaped groove 125, pressing on the elastomer portion 121 as if widening the groove 125. Thus, as the projection 151 enters the V-shaped groove 125, the slanted surface of the V-shaped groove 125 conforms to the contour of the projection 151, airtightly sealing between the projection 151 and the slanted surface of the V-shaped groove 125. As a result, the ink outlet 102 is airtightly sealed.

Figure 5:
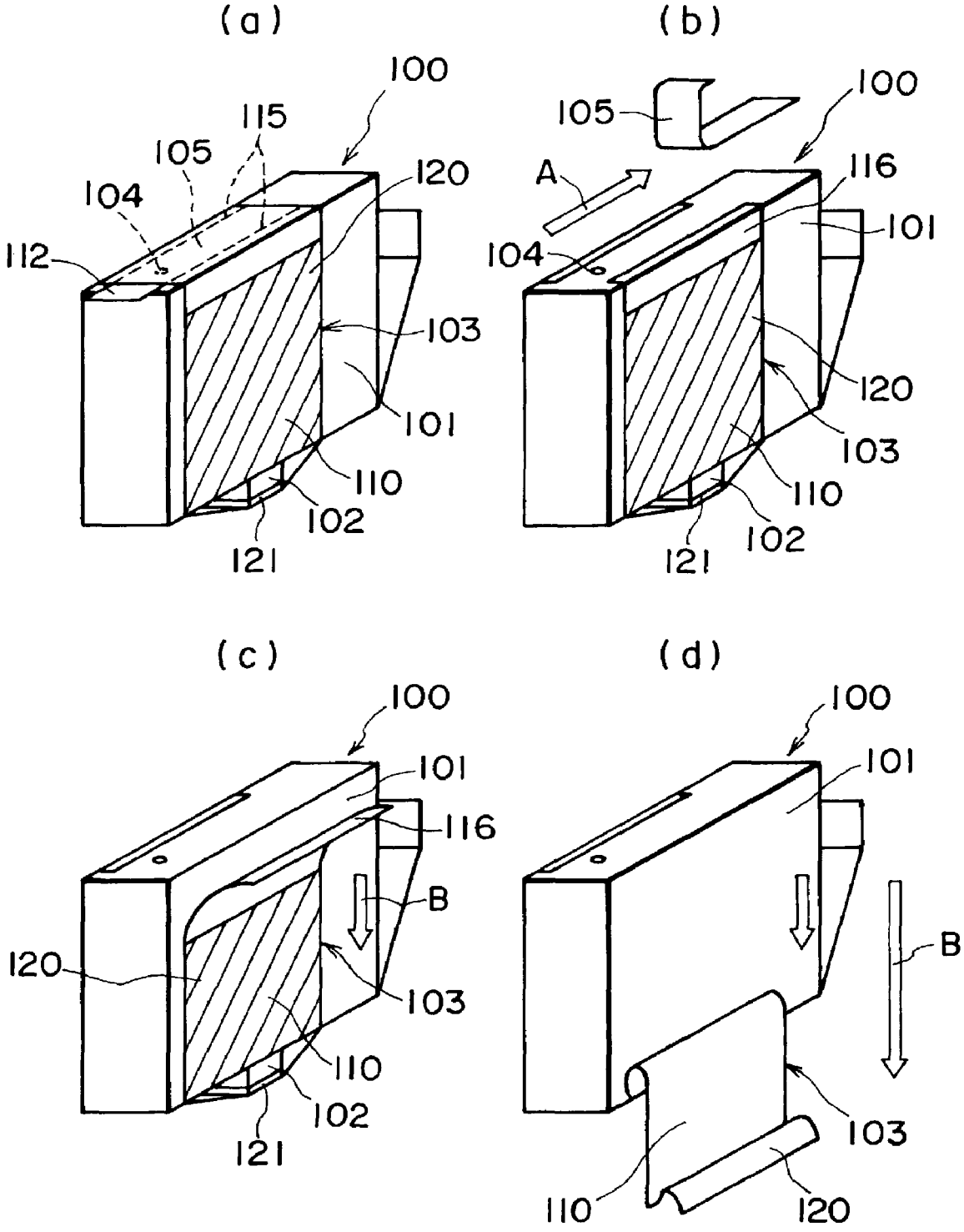
FIG. 5 is a perspective drawing of the ink container in FIG. 1, for showing the method for peeling the sealing jacket from the ink container in FIG. 1, FIG. 1(*a*) corresponding to the ink container prior to the unsealing of the ink outlet of the ink container.
Figure 6:
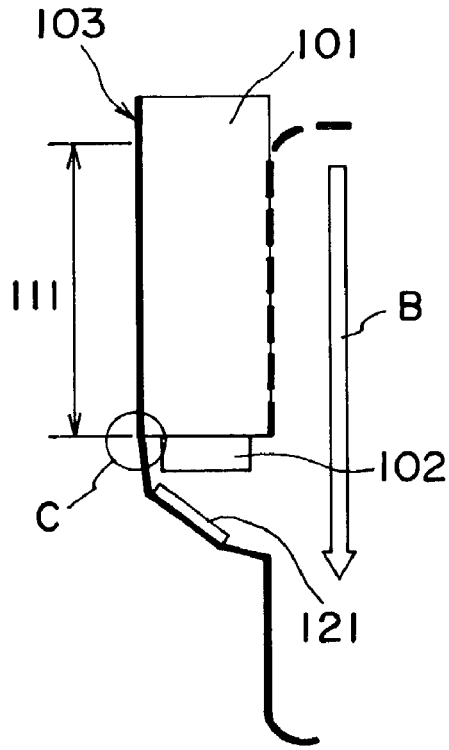
FIG. 6 is a frontal plan view of the ink container in FIG. 1, during the unsealing of the ink outlet thereof.

Next, referring to FIGS. 5(*a*)-5(*d*), and FIG. 6, one of the primary objects of the present invention, that is, a method for unsealing an ink container in accordance with the present invention, will be described. FIG. 5(*a*) is a perspective view of an ink container 100 in accordance with the present invention prior to the unsealing of the ink outlet 102; FIG. 5(*b*), a perspective view of the same during the removal of the sealing member 105; FIG. 5(*c*), a perspective view of the ink container shortly after the beginning of the peeling of the first adherent portion 110 of the wrapping belt portion 120; and FIG. 5(*d*) is a perspective view of the same during the advanced stage of the peeling of the first adherent portion 110 of the wrapping belt portion 120. FIG. 6 is a frontal plan view of the ink container 100 in accordance with the present invention during the unsealing of the ink outlet 102.

This embodiment of an ink container in accordance with the present invention is to be unsealed in the following order. First, the sealing member 105 covering the air vent 104 is to be removed to expose the air vent 104. This process should be carried out first for the following reason. The internal pressure of the ink container proper 101 sometimes becomes higher than the ambient pressure due to the changes in the ambient factors, for example, temperature. Thus, it is possible that ink will splash out of the unsealed openings of the ink container proper 101 as the ink container proper 101 is unsealed. This possibility is greater when the ink outlet side of the ink container proper 101, where the ink content in the negative pressure generating member 132 in the ink container proper 101 is greater than in the rest of the negative pressure generating member 132, is unsealed first than when the air vent side of the ink container proper 101, where the ink content in the negative pressure generating member 132 (FIG. 2) in the ink container proper 101 is less than in the rest of the negative pressure generating member 132 is unsealed first. This is why the sealing member 105 covering the air vent 104 should be removed first.

First, a user is to remove the sealing member 105 by grasping the tab 112 (FIG. 5(*a*)) of the sealing jacket 103 extending beyond the corresponding lateral surface of the ink container proper 101. Since the pair of straight perforations 115 for making it easier for the sealing member 105 to be removed border between the sealing member 105 and the rest of the sealing jacket 103, it is easy for the user to tear the sealing jacket 103 to remove the sealing member 105. The user can confirm, by finding these perforations, whether the direction in which the user is about to peel the sealing member 105 is right or wrong. As the sealing member 105 is pulled by the user in the direction indicated by an arrow mark A in the drawing, not only does the sealing member 105 become separated from the ink container proper 101, but also, the portion of the sealing jacket 103 between the two perforations 115 is removed. As the sealing member 105 is removed, the air vent 104 is exposed. Further, the removal of the portion of the sealing jacket 103 between the two perforations 115 gives the sealing jacket 103 a U-shaped cross section as seen from the direction parallel to its surface.

Incidentally, it is desired that the tab 112 of the sealing member 105 is provided with a clear marking for allowing a user to recognize the presence of the tab 112.

Next, the peeling of the sealing jacket 103 will be described. After the removal of the sealing member 105, the sealing jacket 103 remains attached to the ink container proper 101, being in conformation to the external contour of the ink container proper 101, and therefore, maintaining the aforementioned U-shaped cross section (FIG. 5(*b*)). The user is to peel the sealing jacket 103 by grasping one of the ends of the sealing jacket 103 remaining adhered to the two surfaces of the ink container proper 101 which oppose each other with the presence of the surface of the ink container proper 101 with the ink outlet 102 between them. In terms of the widthwise direction of the sealing jacket 103, the first adherent portion 110 of the sealing jacket 103 (FIG. 1(*b*)), and the second adherent portion 110 of the sealing jacket 103 on the opposite side with respect to the ink container proper 101 (FIG. 1(*b*)), are adhered to the ink container proper 101 from one edges to the others. However, in terms of the lengthwise direction of the sealing jacket 103, the portions of the sealing jacket 103 next to the aforementioned perforations 115, were not made adherent. These portions of the sealing jacket 103 constitute the tab 116 for grasping the sealing jacket in order to peel the sealing jacket 103. This embodiment of an ink container, that is, the ink container 100, is structured so that it is unnecessary to clearly indicate the direction in which the sealing jacket 103 is to be peeled; the sealing jacket 103 can be peeled from either end. For the sake of convenience in description, the clockwise direction is assumed to be the right direction in which the sealing jacket 103 is to be peeled.

The first adherent portion 110 (FIG. 1(*b*)), and the second adherent portion 111 on the opposite side with respect to the ink container proper 101 (FIG. 1(*b*)), are adhered from one edge to the other in terms of the widthwise direction of the sealing jacket 103, making it difficult to peel the sealing jacket 103 without using the tab 112, and therefore, compelling the user to remove the sealing jacket 103 primarily using the tab 112 defined by the present invention.

In order to peel the sealing jacket 103, first, the adherent portion 110 is to be pulled in the direction indicated by an arrow mark B as shown in FIG. 5(*c*). A user should know that the sealing jacket 103 should be gradually peeled, instead of abruptly, because the first adherent portion 110 is pasted to the surface of the ink container proper 101 by a substantial length in terms of the lengthwise direction of the sealing jacket 103. As the user gradually peels the first adherent portion 110, the user can realize the proper amount of force (stress) necessary to peel the sealing jacket 103, refraining from applying an excessive amount of force to abruptly peel the sealing jacket 103.

As the first adherent portion 110 is gradually peeled to its bottom edges, the peeling of the first adherent portion 110 ends. The moment the peeling of the first adherent portion 110 ends, the adhesive strength, between the first adherent portion 110 and corresponding surface of the ink container proper 101, against which force is applied by the user to peel the sealing jacket 103 becomes zero. Therefore, without the anticipation of the end of the peeling of the sealing jacket 103, the hand of the user may be let go suddenly in the direction indicated by the arrow mark B the moment the peeling of the first adherent portion 110 ends. This problem that the hand of the user grasping the sealing jacket 103 is let go abruptly in the arrow direction can be prevented by regulating the amount of the adhesive strength between the first adherent portion 110 and the corresponding wall of the ink container proper 101.

Referring to FIG. 6, after the completion of the peeling of the first adherent portion 110, the cap 121 which was kept by the sealing jacket 103, in the position in which it seals the ink outlet 102, is removed from the ink outlet 102 in a manner to rotate about the edge (rotational center C in FIG. 6) of the second adherent portion 111 closest to the ink outlet 102, unsealing the ink outlet 102. As described above, during this process of removing the cap 121, the movement of the hand of the user remains well controlled, that is, the user's hand does not move jerkingly. Therefore, the phenomenon that the ink between the ink outlet 102 and cap 121 splashes, instead of remaining adhered to the ink outlet 102 and/or cap 121, as it is accelerated by the sudden movement of the sealing jacket 103 caused by the jerky movement of the user's hand, does not occur. Further, the sudden reduction of the force necessary to peel the sealing jacket 103 to zero makes it possible for the user to sense the completion of the unsealing of the ink outlet 102.

Figure 13:
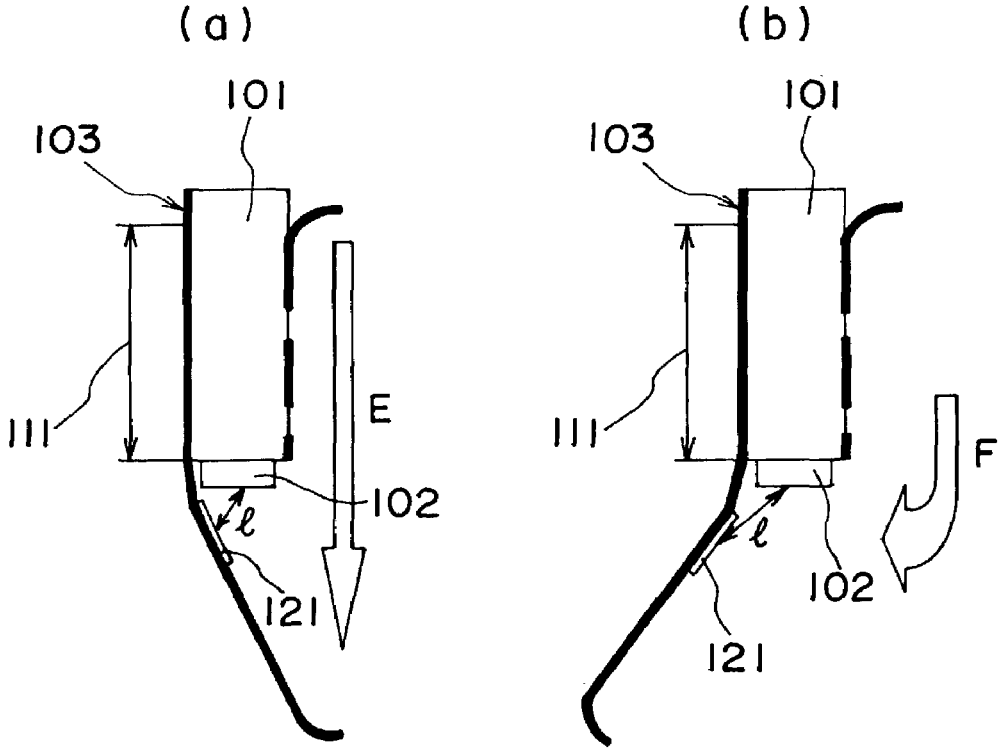
FIG. 13 is a frontal plan view of the ink container in FIG. 1, FIG. 13(*a*) showing the ink container after the first adherent portion of the sealing jacket has been peeled, as far as it could be, in the direction parallel to and FIG. 13(*b*) showing the ink container after the sealing jacket has been peeled in the direction which is not parallel to the liquid container surface corresponding in position to the first adherent portion.

Further, when this unsealing method is used, the second adherent portion 111 functions as the stopper for preventing the abrupt peeling of the sealing jacket 103, that is, the cause of the splashing of the ink on the sealing surface of the cap 121, preventing therefore the ink on the sealing surface of the cap 121 from being splashed. Referring to FIG. 6, for the purpose of making the stopper, or the second adherent portion 111, function as soon as the ink outlet is unsealed, it is desired that the bottom edge of the adherent portion 111 coincides with the edge between the surface of the ink container proper 101 to which the second adherent portion 111 is adhered, and the surface of the ink container proper 101 having the ink outlet 102. Further, for the purpose of making the second adherent portion 111 function as the stopper as quickly as possible after the unsealing of the ink outlet 102, the ink outlet 102 should be disposed adjacent to the surface of the ink container proper 101 to which the adherent portion 111 is adhered. Further, in order to ensure that the second adherent portion 111 stops the peeling action, the adhesive strength between the second adherent portion 111 and the corresponding surface of the ink container proper 101 should be greater than that between the first adherent portion 110 and the corresponding surface of the ink container proper 101. As long as the second adherent portion 111 reliably functions as the stopper quickly after the completion of the peeling of the first adherent portion 110, the cap 121 will be held close to the ink outlet 102, almost directly facing the opening of the ink outlet 102. Therefore, should the ink be splashed from the cap 121, the splashed ink flies into the cap 121, being trapped therein, and therefore, being prevented from being splashed beyond the cap 121 and sealing jacket 103. In order to make the second adherent portion 111 more effectively function as the stopper, this embodiment of an ink container, or the ink container 100, has been designed so that the direction, in which the sealing jacket 103 will be pulled just before the ink outlet 102 begins to be unsealed, becomes virtually perpendicular to the surface of the ink container proper 101 having the ink outlet 102. This is for the following reason. The moment the peeling of the first adherent portion 110 of the sealing jacket 103 is completed, the force applied to peel the first adherent portion 110 turns into such force that works in the direction to shear the second adherent portion 111. Thus, the above described design is employed to make it rather difficult to remove the second adherent portion 111. Next, referring to FIGS. 13(*a*) and 13(*b*), what will occur as the first adherent portion 110 is peeled in various manners by a user will be described. FIG. 13(*a*) shows the ink container 100, the sealing jacket 103 of which is extended as far as it can be extended, in the direction indicated by an arrow mark E, which is parallel to the surface of the ink container proper 101 to which the first adherent portion 110 had once been adhered. FIG. 13(*b*) shows the ink container 100, the sealing jacket 103 of which is being pulled in the direction indicated by an arrow mark F, which is not parallel to the surface of the ink container proper 101, to which the first adherent portion 110 had once been adhered. Even if the sealing jacket 103 is peeled as shown in FIG. 13(*a*) or 13(*b*), the presence of the second adherent portion 111, which functions as the stopper, regulates the distance (1) from the cap 121 to the ink outlet 102. When a conventional sealing jacket (tape) as the sealing means was employed, the distance between the cap 121 and ink outlet 102 was not regulated after the unsealing of the ink outlet 102. In comparison, when a sealing jacket 103 in accordance with the present invention is employed, the distance (l/t) the cap 121 is moved from the ink outlet 102 per unit of time (t) can be substantially smaller, making it possible to prevent the ink splash.

With the provision of the structural arrangement in this embodiment, should ink splash, the sealing jacket 103 itself functions as an ink catcher, minimizing the contamination traceable to the ink splash.

The second adherent portion 111 of the sealing jacket 103 is to be peeled after the unsealing of the ink outlet 102. The second adherent portion 111 is also adhered to the ink container proper 101 across a substantial range, as is the first adherent portion 110, in terms of the lengthwise direction of the sealing jacket 103. Thus, the user is to gradually peel the sealing jacket 103, while sensing the force necessary for peeling the second adherent portion 111 of the sealing jacket 103. During this process of peeling the second adherent portion 111, the sealing surface of the cap 121, on which ink is present, can be seen. Therefore, the user is reminded that the adherent portion 111 of the sealing jacket 103 must also be cautiously peeled until the sealing jacket 103 is completely removed.

Figure 12:
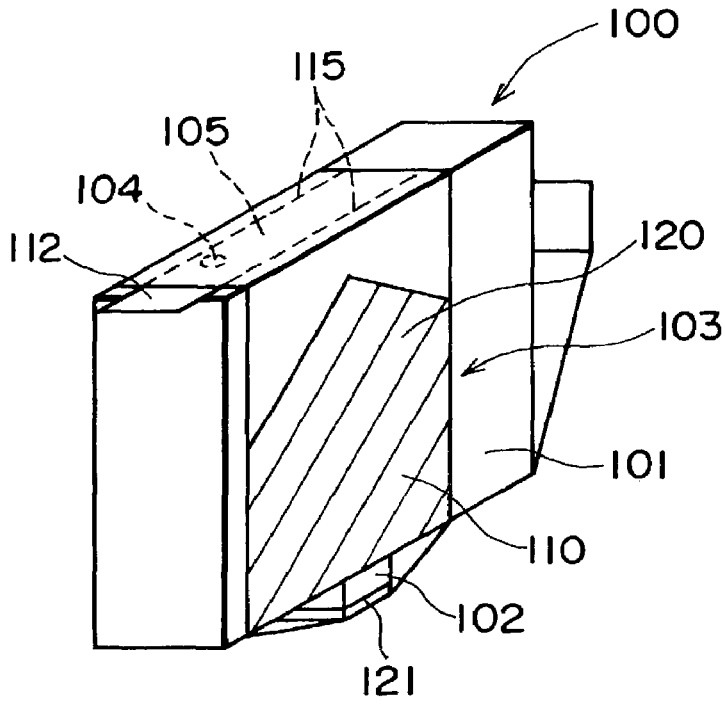
FIG. 12 is a perspective view of the ink container in FIG. 1, for showing the adherent portion of the sealing jacket.

In this embodiment, the first and second adherent portions 110 and 111 are adhered to the ink container proper 101 across the entire range in term of the widthwise direction of the sealing jacket 103. However, in order to reduce the amount of the force necessary at the initial stage of the peeling of the sealing jacket 103, they may be adhered in a different pattern such as the one shown in FIG. 12; the employment of such a pattern causes no problem at all.

The actions required of a user in order to unseal the ink outlet 102 of this embodiment of the present invention, that is, the ink container 100, are only to peel the sealing member 105 and to peel the sealing jacket 103 as shown in FIGS. 5(*a*)-5(*d*). In both actions, all that is required to peel them is to grasp the tab, or the tab-like portion, and pull it; in other words, anyone can easily unseal the ink outlet 102.

Embodiment 2

Next, referring to FIG. 7, the second embodiment of an ink container in accordance with the present invention will be described.

Figure 7:
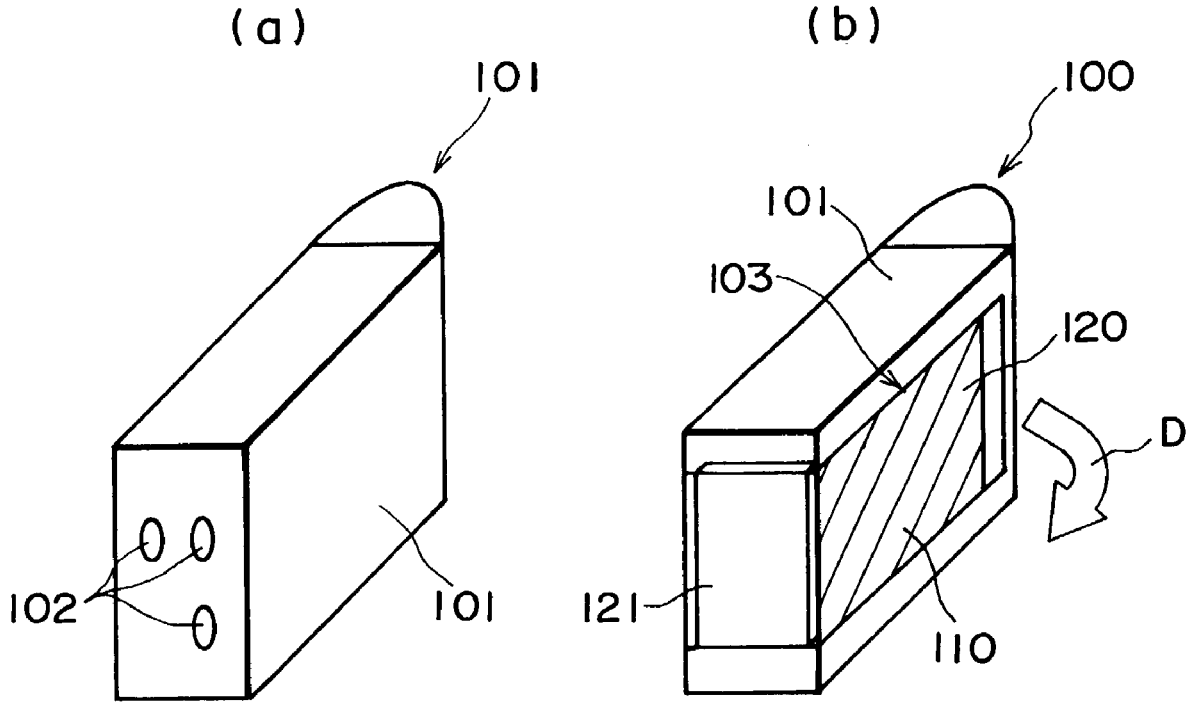
FIG. 7 is a perspective view of the second embodiment of an ink container in accordance with the present invention, FIG. 7(*a*) showing the ink container after the unsealing thereof, and FIG. 7(*b*) showing the ink container, the ink outlet of which is sealed with the sealing jacket.

FIG. 7 shows the second embodiment of an ink container in accordance with the present invention. FIG. 7(*a*) is a perspective view of the ink container in the unsealed state, and FIG. 7(*b*) is a perspective view of the ink container, the ink outlet of which is sealed with the sealing jacket.

The ink container 100 structured as depicted in FIG. 7 is a liquid container capable of holding three inks different in color in its ink container proper 101, having three ink outlets 102. The ink container 100 has three chambers partitioned by ribs. Each chamber is filled with a negative pressure generating member (FIG. 2), holding an ink different in color from the inks in the other chambers. The ink container proper 101 is in the form of a rectangular parallelepiped, and is greater in the vertical dimension than in the horizontal dimension as shown in FIG. 7.

The sealing jacket 103 is formed of rubber, and is U-shaped. This embodiment of an ink container 100 is relatively flat, and the sealing jacket 103 covers the ink container 100 across the three surfaces: the surface with the ink outlet 102, and the largest pair of surfaces sandwiching the surface having the ink outlet 102 (surfaces contiguous to surface with ink outlet). The direction in which the sealing jacket 103 is laid does not need to be limited to the direction in which the sealing jacket 103 of this embodiment is laid; for example, the sealing jacket 103 may be placed across the surface with the ink outlet, and the pair of surfaces contiguous to the surface with the ink outlet, other than the largest pair of surfaces. The sealing jacket 103 has first and second adherent portions 110 and 111, which are positioned so that as the sealing jacket 103 is placed on the ink container 100, they will be on the pair (largest pair) of the surfaces of the ink container proper 101 contiguous to the surface of the ink container proper 101 with the ink outlet 102. The first and second adherent portions 110 and 111 are glued to the corresponding surfaces of the ink container proper 101. The sealing jacket 103 is formed of elastic rubber. Therefore, the sealing jacket 103 can be glued to the ink container proper 101, in the stretched state, so that the ink outlet 102 is airtightly sealed by the cap 121. Even through this ink container 100 has three ink outlets, all three ink outlets 102 can be sealed with a single cap 121 without causing any problem. The method for unsealing the ink outlets 102 is the same as the method for unsealing the ink outlet of the first embodiment of the present invention; the sealing jacket 103 is to peeled in the direction indicated by an arrow mark D in FIG. 7(*b*).

Like the first embodiment, this embodiment can prevent the phenomenon that the ink between the ink outlet 102 and cap 121 splashes, instead of remaining adhered to the ink outlet 102 and/or cap 121, as it is accelerated by the sudden movement of the sealing jacket 103 caused by the jerky movement of the hand of the user. Further, the second adherent portion 111 functions as the stopper for temporarily halting the peeling action of the user, preventing therefore the ink on the sealing surface of the cap 121 from being splashed.

Embodiment 3

Next, referring to FIG. 8, the third embodiment of an ink container in accordance with the present invention will be described.

Figure 8:
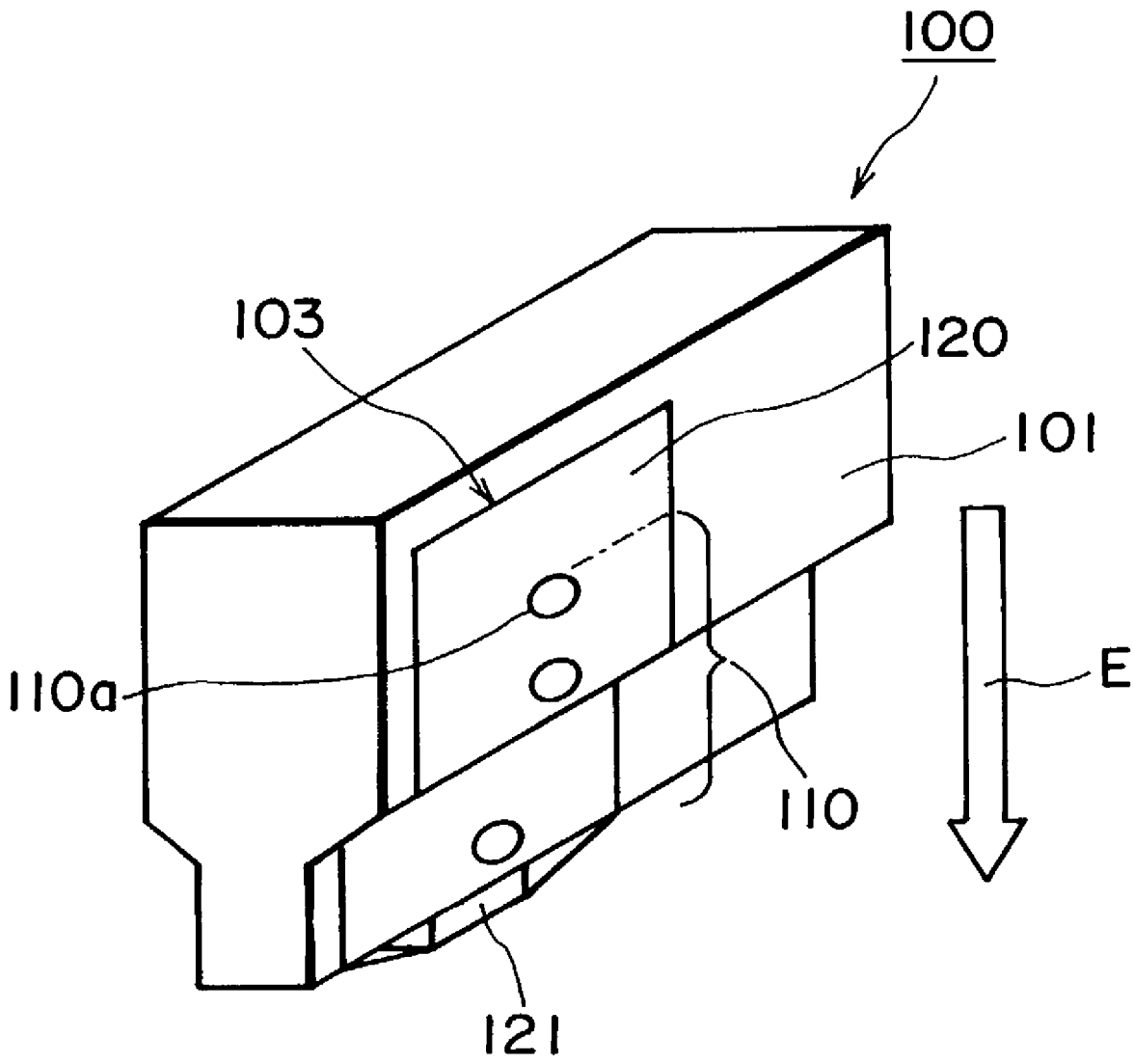
FIG. 8 is a perspective view of the third embodiment of an ink container in accordance with the present invention, the ink outlet of which is sealed with the sealing jacket.
Figure 9:
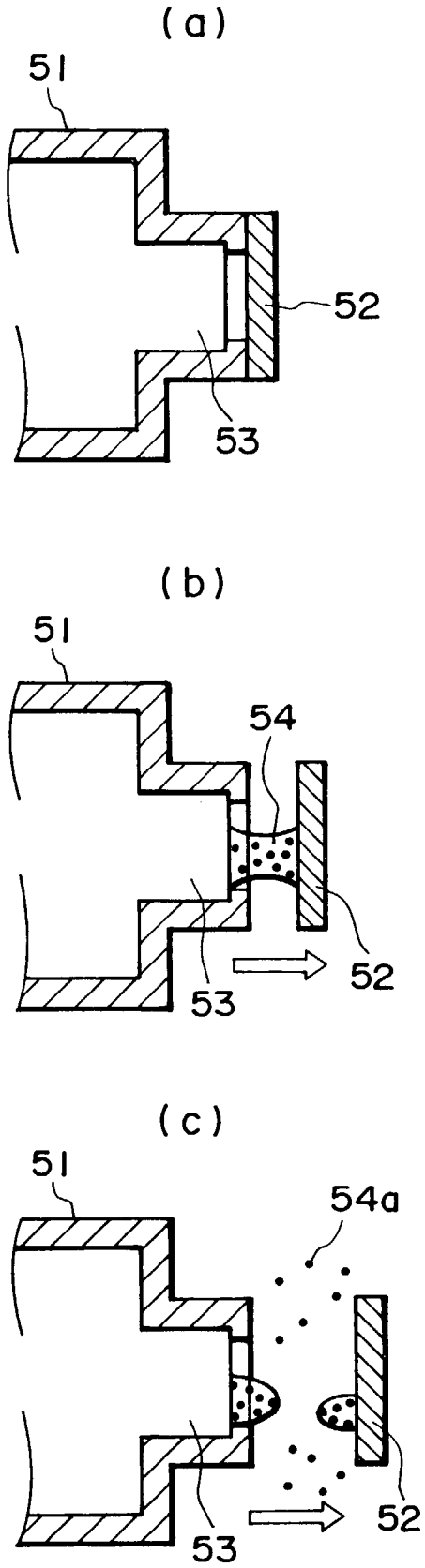
FIG. 9 is a sectional drawing of the ink outlet of an ink container in accordance with the prior art, for describing the causes of the ink splash which occurs when the ink container is unsealed.
Figure 10:
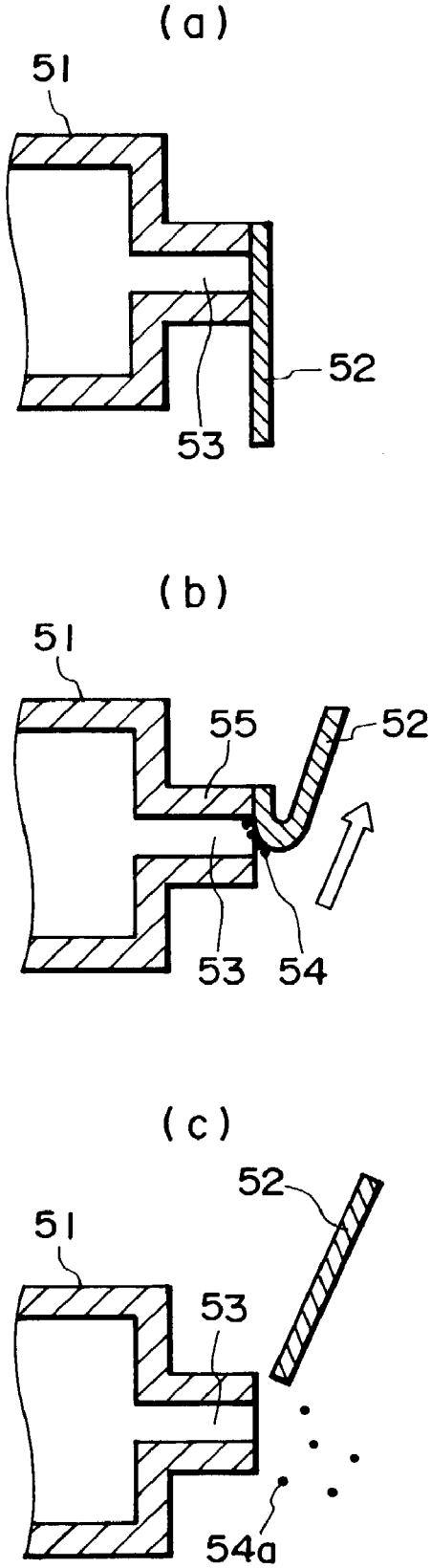
FIG. 10 is a sectional drawing of the ink outlet of an ink container in accordance with the prior art, for describing the causes of the ink splash which occurs when the ink container is unsealed.

FIG. 8 is a perspective view of the third embodiment of the present invention, the ink outlet of which is sealed with the sealing jacket.

The ink container 100 shown in FIG. 8 has two chambers: an ink storage chamber, and a negative pressure generating member storage chamber filled with a negative pressure generating member. The wall of the ink storage chamber has an ink outlet (unshown), the opening of which is filled with a filter (unshown).

The sealing jacket 103 is formed of film, and is U-shaped. This embodiment of an ink container 100 is relatively flat, and the sealing jacket 103 covers the ink container 100 across the three surfaces: the surface with the ink outlet 102, and the largest pair of surfaces sandwiching the surface having the ink outlet 102 (surfaces contiguous to surface with ink outlet). Each of the largest pairs of surfaces has a step. The direction in which the sealing jacket 103 is placed on the ink container proper 101 does not need to be limited to the direction in which the sealing jacket 103 of this embodiment is placed; for example, the sealing jacket 103 may be placed across the surface with the ink outlet, and the pair of surfaces contiguous to the surface with the ink outlet, other than the largest pair of surfaces. The sealing jacket 103 has first and second adherent portions 110 and 111, which are positioned so that as the sealing jacket 103 is placed on the ink container 100, they will be on the pair (largest pair) of the surfaces of the ink container proper 101 contiguous to the surface of the ink container proper 101 with the ink outlet 102. The first adherent portion 110, and the second adherent portion 111 which opposes across the ink container proper 101, are spot-welded to the corresponding surfaces of the ink container proper 101. The method for unsealing the ink outlets 102 is the same as the method for unsealing the ink outlet of the first and second embodiments of the present invention; the sealing jacket 103 is to be peeled in the direction indicated by an arrow mark E in FIG. 8.

The sealing jacket 103 is to be peeled in the following manner. Referring to FIG. 8, first, the adherent portion 110 is to be pulled in the direction indicated by the arrow mark E. A user should know that the sealing jacket 103 should be gradually peeled, instead of abruptly, because the first adherent portion 110 is spot-welded to the surface of the ink container proper 101 at plural spots 110*a* in a straight line in the lengthwise direction of the sealing jacket 103. As the user gradually peels the first adherent portion 110, the user can realize the proper amount of force (stress) necessary to peel the sealing jacket 103, being enabled to refrain from applying an excessive amount of force which will result in the abrupt peeling the sealing jacket 103.

As the first adherent portion 110 is gradually and continually peeled to its bottom edges, which coincide with the bottom edge of the ink container proper 101, the peeling of the first adherent portion 110 ends. At the same time as the peeling of the first adherent portion 110 ends, the adhesive strength, between the first adherent portion and the corresponding surface of the ink container proper 101, against which force is applied to the sealing jacket 103 to peel the sealing jacket 103 becomes zero. Therefore, without the anticipation of the loss of the resistance from the adhesive strength between the first adherent portion 110 and the corresponding wall of the ink container proper 101 at the end of the peeling of the first adherent portion 110 of the sealing jacket 103, the hand of the user may be suddenly let go in the direction indicated by the arrow mark E due to the loss of resistance, at the same time as the peeling of the first adherent portion 110 ends. This problem that the hand of the user grasping the sealing jacket 103 is suddenly let go in the arrow direction can be avoided by setting the adhesive strength between the first adherent portion 110 and the corresponding wall of the ink container proper 101 to a level at which an excessive amount of force is not necessary to peel the first adherent portion 110.

Referring to FIG. 6, after the completion of the peeling of the first adherent portion 110, the cap 121 which was kept, by the sealing jacket 103, in the position in which it seals the ink outlet 102, is removed from the ink outlet 102 in a manner to rotate about the welding spot (unshown) of the second adherent portion 111 closest to the ink outlet 102, unsealing the ink outlet 102. As described above, during this process of removing the cap 121, the movement of the hand of the user remains well controlled, and therefore, it does not occur that the ink outlet 102 is abruptly unsealed. Therefore, the phenomenon that the ink between the ink outlet 102 and cap 121 is accelerated by the abrupt movement of the sealing jacket 103 caused by the jerky movement of the user's hand, and splashes, instead of remaining adhered to the ink outlet 102 and/or cap 121, does not occur. Further, the sudden loss of the resistance coming from the adhesive strength between the first adherent portion 110 and ink container proper 101 makes it possible for the user to sense the completion of the unsealing of the ink outlet 102.

Like the first and second embodiments, this embodiment can also prevent the sealing jacket 103 from being jerked at the end of the peeling of the first adherent portion 110 during the unsealing of the ink outlet 102, preventing therefore the phenomenon that the ink between the ink outlet 102 and cap 121 is accelerated by the jerking of the user's hand, and splashes, instead of remaining adhered to the ink outlet 102 and/or cap 121. Further, this embodiment is also capable of preventing the ink on the sealing surface of the cap 121 from splashing.

Embodiment 4

Figure 14:
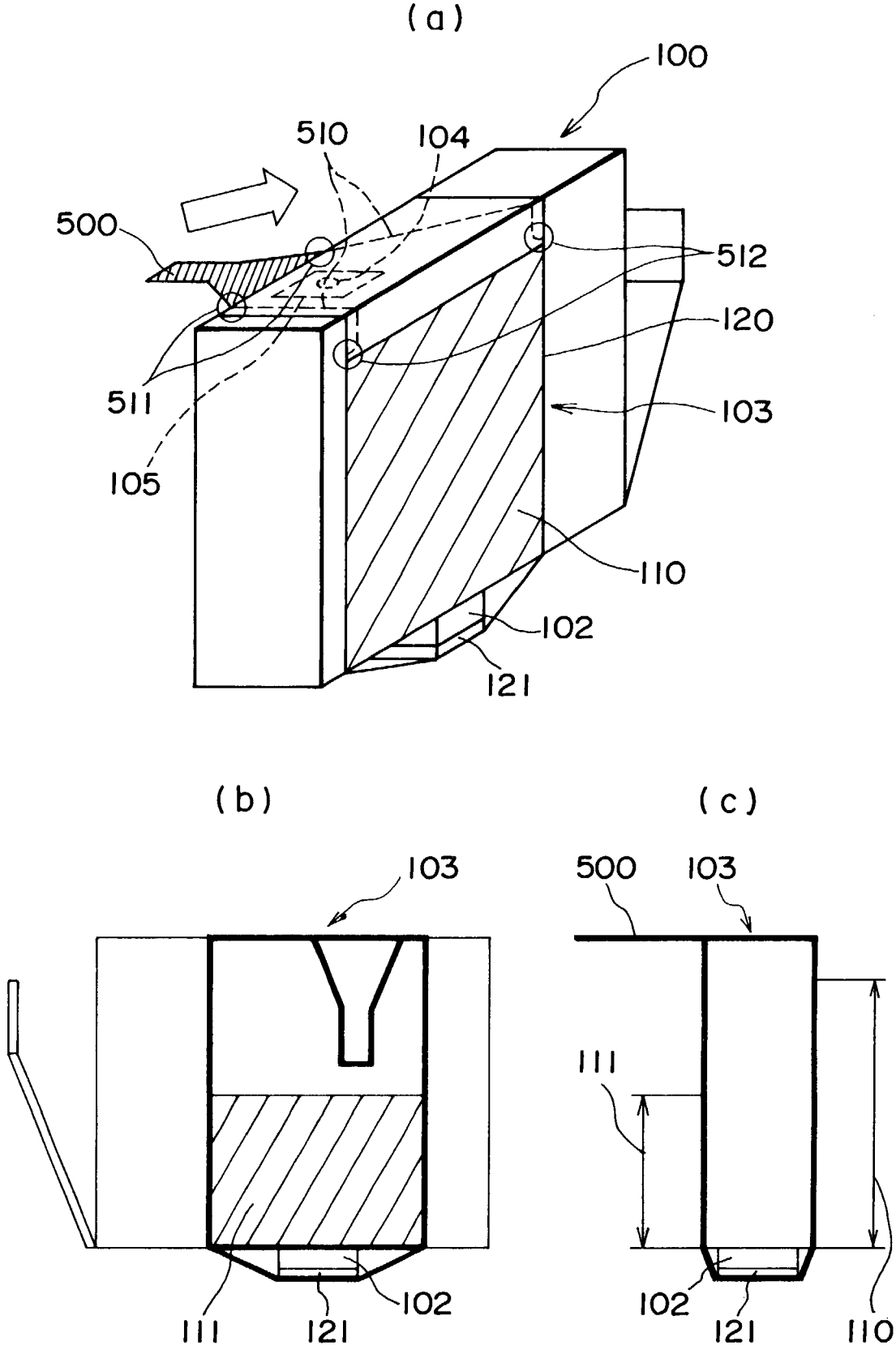
FIG. 14 is a drawing of the fourth embodiment of an ink container in accordance with the present invention, FIGS. 14(*a*) and 14(*b*) being perspective and frontal plan views, respectively.

Next, referring to FIG. 14, the fourth embodiment of the present invention will be described. This embodiment of an ink container in accordance with the present invention is similar to the first embodiment, except for the sealing jacket 103 and sealing member 105. Thus, this embodiment will be described regarding only the sealing jacket 103 and sealing member 105, and the method for unsealing the portions sealed by the sealing jacket 103 and sealing member 105. FIG. 14(*a*) is a perspective view of this embodiment, and FIG.

14(*b*) is a side view of this embodiment. FIG. 14(*c*) is a frontal plan view of this embodiment.

First, referring to FIG. 14, the sealing jacket 103 of the ink container 100 will be described. The sealing jacket 103 comprises a wrapping belt portion 120 and a sealing jacket 103 formed of the same materials as the materials for the wrapping belt portion 120 and sealing jacket 103 of the first embodiment. It is wrapped around the ink container proper 101. It is long enough to be extendable a certain length from the ink container proper 101 roughly in parallel to the surface of the ink container proper 101, that is, perpendicular to the pair of the largest surfaces of the ink container proper 101, after being wrapped once around the ink container proper 101. It is formed by cutting a part of the sealing jacket 103 in the form of a tab. Further, this sealing jacket 103 is provided with two straight perforations 510, which extend one for one from the two ends (tear start points 510) of the base portions of the tab 500 in such a manner that as the sealing jacket 103 is wrapped around the ink container proper 101, the two perforations reach the virtually the bottom edge (tear stop points 512) of the ink container proper 101. The first and second adherent portion 110 and 111 of this embodiment are the same as those of the first embodiment; they are positioned so that as the sealing jacket 103 is wrapped around the ink container proper 101, they will be on the two lateral surfaces (two surfaces contiguous to surface with ink outlet 102) of the ink container proper 101, which oppose each other, sandwiching the surface with the ink outlet 102.

Next, the sealing member 105 will be described. The sealing member 105 is square and is formed of film. It is adhered to the ink container proper 101 so that it seals the air vent 104. The sealing member 105 should be peeled before the ink container 100 is mounted into an ink jet recording apparatus (unshown). Therefore, semipermanent adhesive or thermal welding is used as the means for attaching the sealing jacket 103 to the ink container proper 101. The sealing member 105 is attached to the sealing jacket 103 with the use of such an adhesive, or a thermal welding method, that makes the adhesive strength between the sealing member 105 and sealing jacket 103 greater than the force necessary to remove the sealing member 105 from the air vent 104. This is done in order to accomplish two objectives, that is, the unsealing of the ink container 100 and the unsealing of the air vent, by a single action, that is, by simply peeling the portion of the sealing jacket 103 between the two perforations. The details of the unsealing of this embodiment of an ink container in accordance with the present invention will be described later.

Next, the method for unsealing this embodiment of an ink container in accordance with the present invention will be described. The unsealing method will be described up to the stage at which the air vent is unsealed, and the processes thereafter will be not be described because they are the same as those for the first embodiment.

The ink container is to be unsealed in the following manner. First, a user is to grasp the tab 500 of the sealing jacket 103, and pull it to sever the sealing jacket 103, while peeling the sealing jacket 103 in the direction in which the sealing jacket 103 is wrapped around the ink container proper 101. The sealing jacket 103 is provided with the two perforations 510 along which the sealing jacket 103 is easily severable. The two perforations 510 extend from the two ends (tear start points) of the base portion of the tab 500. Thus, as the user grasps the tab 500 and pulls it in the direction in which the sealing jacket 103 is wrapped, the sealing jacket 103 will easily tear along the perforations 510, allowing the portion of the sealing jacket 103 between the two perforations to be easily peeled. During this process, the user can assure him/herself, by finding the perforations, that the sealing jacket 103 is being peeled in the correct direction.

As the portion of the sealing jacket 103 between the two perforations is peeled to the position of the sealing member 105, the sealing member 105 begins to be peeled away from the ink container proper 101 along with the sealing jacket 103, exposing the air vent 104. This occurs because the adhesive strength between the sealing member 105 and sealing jacket 103 is greater than that between the sealing member 105 and ink container proper 101, and therefore, the sealing member 105 remains stuck to the sealing jacket 103 as the sealing jacket 103 is peeled. The sealing member 105 is glued to the ink container proper 101 firmly enough to keep the air vent 104 sealed. Thus, as the sealing jacket 103 is peeled to the position of the sealing member 105, the force being applied to the sealing jacket 103 to peel the sealing jacket 103 must be increased. Therefore, unless a certain measure is taken, the hand of the user pulling the tab 500 will be let go jerkingly and uncontrollably, abruptly peeling the portion of the sealing jacket 103 which comes after the sealing member 105, as the same time as the sealing member 105 is completely peeled. In the case of this embodiment, however, there is the first adherent portion 110 close to the ends 512 of the perforations 510, and the first adherent portion 110 functions as the stopper for controlling the jerky movement of the user's hand. In other words, the first adherent portion 110 can temporarily halt the peeling of the sealing jacket 103 to prevent the following problem. That is, if the ink outlet 102 is unsealed, with the user's hand moving at the same velocity as the velocity at which it began to move due to the sudden reduction in the resistance to the force applied by the user's hand to the tab 500 to peel the portion of the sealing jacket 103 having the sealing member 105, ink will be splashed. With the presence of the first adherent portion 110, the jerky movement of the user's hand is prevented from continuing.

Up to the above described stage, this unsealing method can be easily carried out by anybody, because all that has to be done is to grasp and pull the tab 500 to peel the sealing jacket 103.

Next, the process of peeling of the first adherent portion 110, process of unsealing of the ink outlet 102, and process of peeling of the second adherent portion 111, are carried out. These processes and the effects thereof are the same as those for the first embodiment; in other words, the ink container 100 can be easily unsealed without splashing ink.

Incidentally, the employment of the sealing member 105 is not mandatory. In other words, the air vent 105 may be directly sealed by the sealing jacket 103.

Embodiment 5

Figure 15:
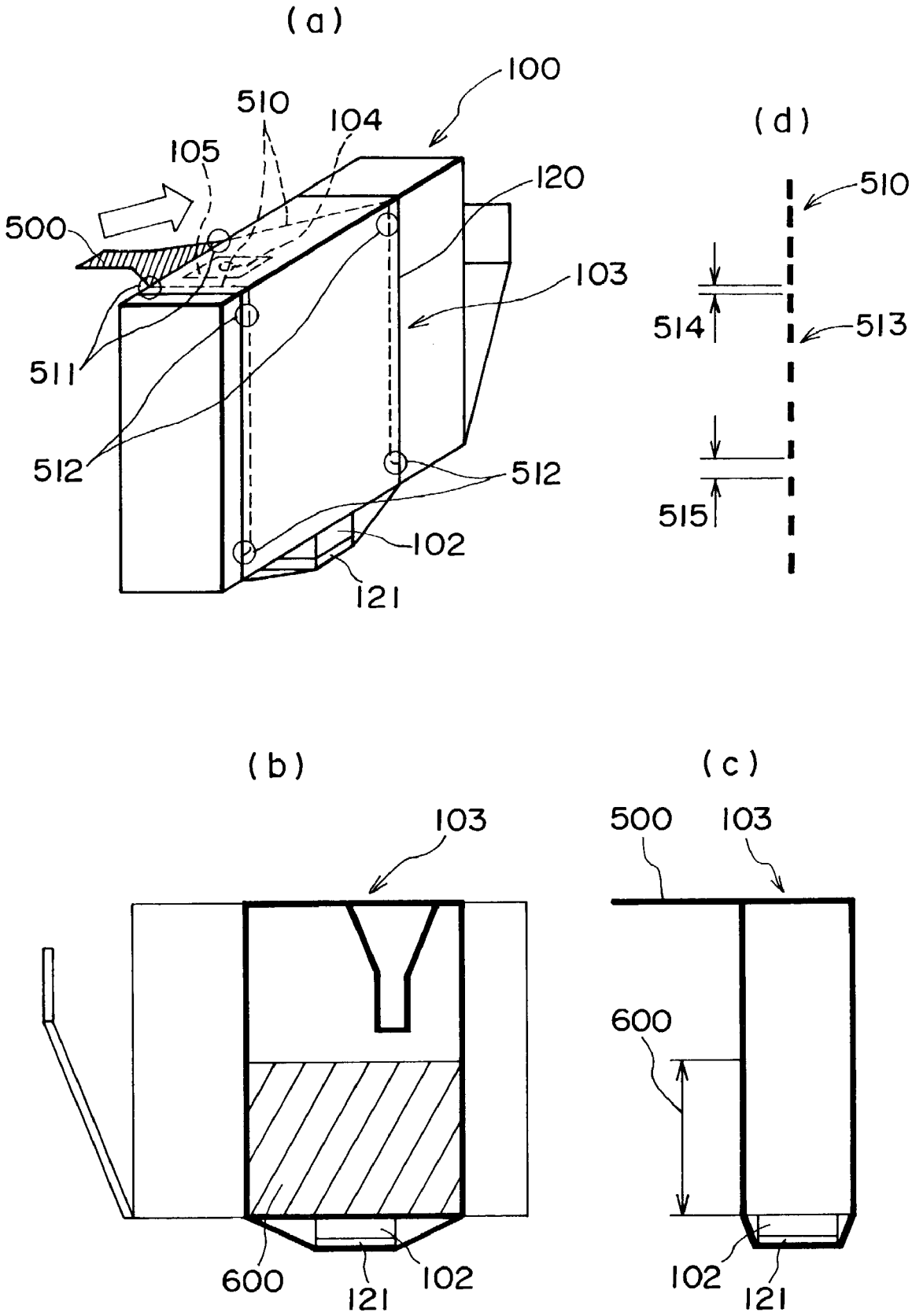
FIG. 15 is a drawing of the fifth embodiment of the present invention in accordance with the present invention, FIGS. 15(*a*), 15(*b*), 15(*c*), and 15(*d*) being perspective view, side view, front view, and enlarged view of the cut interval change point, and its adjacencies, of one of the two perforations, at which the cut interval of the perforation is changed, respectively.

Next, referring to FIG. 15, the fifth embodiment of an ink container in accordance with the present invention will be described. This ink container 100 is similar to the first and fourth embodiments of the present invention, except that the sealing jacket 103 of this ink container 100 is different from that of the fourth embodiment. Thus, this embodiment will be described regarding only the portion of the unsealing method involving the sealing jacket 103 and the portion of the ink container proper 101 covered with the sealing jacket 103. FIG. 15(*a*) is a perspective view of this embodiment of an ink container in accordance with the present invention; FIG. 15(*b*), a side view of the same; FIG. 15(*c*), the frontal plan view of the same; and FIG. 15(*d*) is an enlarged view of the cut interval change point, and its adjacencies, of the perforations of this embodiment of a sealing jacket 103.

First, referring to FIG. 15, the sealing jacket 103 itself will be described. The sealing jacket 103 comprises a wrapping belt portion 120 and a cap 121 formed of the same material as those for the first and fourth embodiments. It is similar to the fourth embodiment in shape, inclusive of its tab 500. The sealing jacket 103 is provided with a pair of perforations 510, which extend from the ends (starting points of perforation 511) of the base line of the tab 500, in the direction parallel to the direction in which the sealing jacket 103 is wrapped around the ink container proper 101, long enough to reach the adjacencies (ends points of perforations 512) of the bottom edge of the surface of the ink container proper 101 contiguous to the surface of the ink container proper 101 having the air vent 104, extending across the two surfaces. Each perforation 510 is has two sections different in the cut interval. The two sections are separated at a cut interval change point 513. In other words, the section between the tear starting point 511 and cut interval change point 513, and the section between the cut interval change point 513 and the tear end point 512, are different in the cut interval, as shown in FIG. 15(*d*). That is, each cut interval 514 of the section of the perforation between the starting point 511 and cut interval change point is shorter and each cut interval 515 of the rest of the perforation, that is, the section of the perforation between the cut interval change point 513 and tear end point 512. Therefore, the sealing jacket 103 is easier to tear along the former than the latter. The sealing member 105 is attached to the portion of the sealing jacket 103 between the two perforations, with the use of such an adhesive, or thermal welding method, that makes the adhesive strength between the sealing member 105 and sealing jacket 103 greater than the adhesive strength between the sealing member 105 and the ink container proper 101 (more specifically, portion which surrounds air vent 104). The adherent portion 600 is positioned so that the rear edge of the adherent portion 600, in terms of the direction in which the sealing jacket 103 is to be peeled, approximately coincides with the end point 512 of each perforation. Since the adherent portion 600 is also to be peeled when unsealing the ink container 100, it is glued to the ink container proper 101 with the use of such an adhesive, or thermal welding method, that allows the adherent portion 600 to be easily peeled.

Next, the method for unsealing this embodiment of an ink container in accordance with the present invention will be described. Herein, the method will be described up to the stage in which the tearing of the sealing jacket 103 along the perforations is completed. Since the processes thereafter for unsealing the ink container 100 are the same as those for the first embodiment, they will not be described.

The ink container 100 is unsealed in the following manner. First, in order to begin unsealing the sealing jacket 103, a user is to grasp the tab 500 of the sealing jacket 103 and pull it in the direction parallel to the direction in which the sealing jacket 103 is wrapped around the ink container proper 101; the sealing jacket 103 is peeled by tearing the sealing jacket 103 along the two perforations 510, which extend from the base portion (tear start point 511) of the tab 500. As the tab 500 is pulled in the direction parallel to the direction in which the sealing jacket 103 is wrapped, the sealing jacket 103 easily tears along the two perforations 510, allowing the portion of the sealing jacket 103 between the two perforations to be easily peeled. During this process, the user should confirm the presence of the perforations at the points at which the sealing jacket 103 is being torn, because this confirmation assures the user that the sealing jacket 103 is being properly torn.

Once the peeling of the portion of the sealing jacket 103 between the two perforations progresses to the location of the sealing member 105, the sealing member 105 begins to be peeled from the ink container proper 101 along with the portion of the sealing jacket 103 between the two perforations, exposing the air vent 104. This occurs because the sealing member 105 is adhered to the sealing jacket 103 and ink container proper 101 in such a manner that the adhesive strength between the sealing member 105 and sealing jacket 103 becomes greater than that between the sealing member 105 and ink container proper 101 (more specifically, portion around air vent 104), and therefore, the sealing member 105 remains attached to the sealing jacket 103.

The amount of force necessary to peel the sealing member 105 from the ink container proper 101 is greater than the amount of force necessary to tear the sealing jacket 103 along the two perforations. Therefore, the user will exert a greater amount of muscular force while peeling the sealing member 105. Then, as soon as the sealing member 105 is completely peeled, the amount of force necessary to peel the sealing jacket 103 suddenly reduces, even through the user is still exerting muscular force by the amount necessary to peel the sealing member 105. Thus, unless a certain measure is taken, the user's hand jerkingly moves while pulling the sealing jacket 103. Consequently, the portion of the sealing jacket 103 between the two perforations after the sealing member 105 will be yanked away. In the case of this embodiment, however, each perforation has two sections different in cut interval. Further, the cut interval change point 513, which divides the perforation into the two sections different in cut interval, is positioned so that it will be on the surface of the ink container proper 101 contiguous to the surface of the ink container proper 101 having the air vent 104. Therefore, the portion of the sealing jacket 103 corresponding to the cut interval change point 513 functions as the stopper for temporarily halting the unsealing of the ink container 100, preventing therefore the yanking of the sealing jacket 103 resulting from above described the jerky movement of the user's hand. More specifically, the cut intervals 514 in the section of each perforation between the tear start point 511 and cut interval change point 513 are relatively short, making it relatively easy to tear the sealing jacket 103 along the perforation, whereas the cut intervals 515 in the section of the perforation between the cut interval change point 513 and end point 512 are relatively long, increasing the amount of the force necessary to tear the sealing jacket 103 along this section of the perforation. Thus, the abrupt peeling of the sealing jacket 103 by the above described jerky movement of the user's hand is stopped by the difference in the amount of force necessary to tear the sealing jacket 103 along the perforation between the two sections of the perforation. In other words, the jerky movement of the user's hand never lasts long enough to peel even the portion of the sealing jacket 103 corresponding to the ink outlet 102. Therefore, the problem that ink is splashed by the abrupt unsealing of the ink outlet 102 does not occur.

After the abrupt tearing of the sealing jacket 103 is stopped by the portion of the sealing jacket 103 having the cut interval change points 513 of the perforations, the user is to start again to peel the portion of the sealing jacket 103 between the two perforations while tearing the sealing jacket 103 along the perforations, to the end points of the perforations 510. As described above, a relatively larger amount of force is required to tear the sealing jacket 103 along the section of the perforation between the cut interval change point 513 and the end point 512, and this section is made long enough, in terms of the direction in which the sealing jacket 103 is wrapped around the ink container proper 101, to make the user realize that this portion of the sealing jacket 103 should be extra carefully peeled, that is, without yanking. Then, while the user is gradually peeling this portion of the sealing jacket 103, the user will accurately sense the amount of force necessary to peel the rest of the sealing jacket 103, being therefore prevented from applying an excessive amount of force; in other words, the user is prevented from jerkingly peeling the remaining portion of the sealing jacket 103.

As the portion of the sealing jacket 103 between the two perforations is gradually peeled to the end points of the 512 of the perforations, the sealing member 103 loses it endless form. Thus, the resistance to the force applied to the sealing jacket 103 by the user to peel it suddenly disappears, which would have caused the user's hand to jerkingly accelerate in the direction in which the user was pulled the sealing jacket 103. In the case of this embodiment, as described above, the user is not applying an excessive amount of force to the sealing jacket 103. Therefore, even when the resistance disappear, the user's hand does not jerkingly accelerate. After the completion of the peeling of the portion of the sealing jacket 103 between the two perforations, the ink outlet 102 is to be unsealed.

As is evident from the above description, all that is necessary up to this point of the method for unsealing this embodiment of an ink container in accordance with the present invention is to grasp the tab 500 and pull it to peel away the sealing jacket 103. Therefore, anybody can easily perform the task.

Thereafter, the process for unsealing of the ink outlet 102, and the process for peeling the adherent portion 600, are to be carried out. These processes and the effects thereof are the same as those for the first embodiment; in other words, the ink container 100 can be easily unsealed without splashing ink.

As described above, the present invention relates to a liquid container jacket for sealing the liquid outlet of a liquid container. According to one of the characteristic aspects of the present invention, a liquid container sealing jacket is provided with a minimum of two portions (first to fourth embodiments) by which it is attached to the liquid container, or a combination of an adherent portion and a tearing means (fifth embodiment) requiring a predetermined amount of force to tear it, which are independently disposed in a manner to sandwich the liquid outlet of the liquid container in terms of the direction in which the sealing jacket is to be peeled. Therefore, the length of the adherent portion to be peeled first (first to fourth embodiments), or the length of the tearing means (first embodiment), makes it possible for the user to recognize the amount of force necessary to peel the sealing jacket, preventing thereby the sealing jacket from being abruptly peeled away by the application of an excessive amount of force.

According to another aspect of the present invention, the portion of the sealing jacket corresponding in position to the liquid outlet is not adhered to the surface of the liquid container. Therefore, as soon as the peeling of the first adherent portion of the sealing jacket (first to fourth embodiments), or the tearing means (fifth embodiment), is completed, the liquid outlet can be unsealed. As described above, during this process, it does not occur that the sealing jacket is abruptly peeled. Therefore, the phenomenon that liquid in or around the liquid outlet is splashed does not occur. Further, the liquid outlet becomes open as the amount of force necessary to peel suddenly reduces to zero, giving the user the sense of completion that the liquid outlet has just been unsealed.

According to another aspect of the present invention, in the case of this sealing jacket, the second adherent portion of the sealing jacket (first to fourth embodiments), or the sole adherent portion of the sealing jacket (fifth embodiment), functions as the stopper for temporarily halting the peeling movement of the user, preventing the sealing member from being abruptly peeled in a single quick stroke, preventing therefore the ink adhering to the sealing jacket from being splashed.

According to another aspect of the present invention, the sealing jacket can be peeled away simply by grasping the tab and pulling it. Therefore, an ink container fitted with the sealing jacked in accordance with the present invention can be easily unsealed by anybody.

While the invention has been described with reference to the structures disclosed herein, it is not confined to the details set forth, and this application is intended to cover such modifications or changes as may come within the purposes of the improvements or the scope of the following claims.

What is claimed is:

1. A packaging structure for a liquid container including a liquid containing portion accommodating liquid, a liquid supply portion for supplying the liquid to an outside, and an air vent for fluid communication with an ambience, wherein said liquid container is substantially in the form of a polyhedron shape substantially constituted by a plurality of sides including one side having said air vent, an opposite side having said liquid supply portion, a first vertical side, and a second vertical side which is opposed to said first vertical side with said one side and said opposite side therebetween;

said packing structure comprising:

a covering member for covering and sealing said liquid supply portion and said air vent, said covering member including:

an air vent sealing portion for sealing said air vent, a liquid supply portion sealing portion for sealing said liquid supply portion, wherein said liquid supply portion sealing portion includes a capping member and wherein said capping member has an elastic member elastically covering said liquid supply portion, and wherein said liquid supply portion is sealed by said elastic member, and first and second connecting regions for respectively covering the first and second vertical sides of said liquid container, and which respectively connect said air vent sealing portion and said liquid supply portion sealing portion, wherein said first connecting region has a first adhesive region which is adhesively adhered to the first vertical side, said second connecting region has a second adhesive region which is adhesively adhered to the second vertical side, and said liquid supply portion sealing portion is not adhesively adhered to said opposite side; and wherein said first adhesive region remains adhered to the first vertical side even after said second adhesive region has been peeled from the second vertical side.

2. A packaging structure according to claim 1, wherein said liquid container is substantially in the form of a rectangular parallelopiped shape substantially constituted by six sides.

3. A packaging structure according to claim 1, wherein said first and second adhesive regions extend to a neighborhood of a corner constituted by the side having said liquid supply portion and the side connecting therewith.

4. A packaging structure for a liquid container including a liquid containing portion accommodating liquid, a liquid supply portion for supplying the liquid to an outside, and an air vent for fluid communication with an ambience, wherein said liquid container is substantially in the form of a polyhedron shape substantially constituted by a plurality of sides including one side having said air vent, an opposite side having said liquid supply portion, a first vertical side, and a second vertical side which is opposed to said first vertical side with said one side and said opposite side therebetween;

said packing structure comprising:

a covering member for covering and sealing said liquid supply portion and said air vent, said covering member including:

an air vent sealing portion for sealing said air vent, a liquid supply portion sealing portion for sealing said liquid supply portion, wherein said liquid supply portion sealing portion includes a capping member, and first and second connecting regions for respectively covering the first and second vertical sides of said liquid container, and which respectively connect said air vent sealing portion and said liquid supply portion sealing portion, wherein said first connecting region has a first adhesive region which is adhesively adhered to the first vertical side, said second connecting region has a second adhesive region which is adhesively adhered to the second vertical side, and said liquid supply portion sealing portion is not adhesively adhered to said opposite side, wherein said second adhesive region of said covering member has a perforation to provide a degree of resistance against tearing; and wherein said first adhesive region remains adhered to the first vertical side even after said second adhesive region has been peeled from the second vertical side.

5. A packaging structure for a liquid container including a liquid containing portion accommodating liquid, a liquid supply portion for supplying the liquid to an outside, and an air vent for fluid communication with an ambience, wherein said liquid container is substantially in the form of a polyhedron shape substantially constituted by a plurality of sides including one side having said air vent, an opposite side having said liquid supply portion, a first vertical side, and a second vertical side which is opposed to said first vertical side with said one side and said opposite side therebetween;

said packing structure comprising:

a covering member for covering and sealing said liquid supply portion and said air vent, said covering member including:

an air vent sealing portion for sealing said air vent, a liquid supply portion sealing portion for sealing said liquid supply portion, wherein said liquid supply portion sealing portion includes a capping member, and first and second connecting regions for respectively covering the first and second vertical sides of said liquid container, and which respectively connect said air vent sealing portion and said liquid supply portion sealing portion, wherein said first connecting region has a first adhesive region which is adhesively adhered to the first vertical side, said second connecting region has a second adhesive region which is adhesively adhered to the second vertical side, and said liquid supply portion sealing portion is not adhesively adhered to said opposite side, and wherein said air vent sealing portion seals said air vent using bonding or welding; and wherein said first adhesive region remains adhered to the first vertical side even after said second adhesive region has been peeled from the second vertical side.

6. A packaging structure according to claim 4, wherein said first and second adhesive regions extend to a neighborhood of a corner constituted by the side having said liquid supply portion and the side connecting therewith.

7. A packaging structure according to claim 5, wherein said first and second adhesive regions extend to a neighborhood of a corner constituted by the side having said liquid supply portion and the side connecting therewith.

* * * * *